US010820705B2

(12) United States Patent
Deevers et al.

(10) Patent No.: US 10,820,705 B2
(45) Date of Patent: Nov. 3, 2020

(54) COMPLIANT SEATING STRUCTURE

(71) Applicant: Steelcase Inc., Grand Rapids, MI (US)

(72) Inventors: Nickolaus Williams Charles Deevers, Holland, MI (US); Kurt R. Heidmann, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 16/257,820

(22) Filed: Jan. 25, 2019

(65) Prior Publication Data

US 2019/0150621 A1 May 23, 2019

Related U.S. Application Data

(63) Continuation of application No. 15/715,496, filed on Sep. 26, 2017, now Pat. No. 10,219,627.

(60) Provisional application No. 62/401,415, filed on Sep. 29, 2016.

(51) Int. Cl.

| | |
|---|---|
| ***A47C 7/02*** | (2006.01) |
| ***A47C 7/14*** | (2006.01) |
| ***A47C 7/40*** | (2006.01) |
| ***A47C 7/44*** | (2006.01) |

(52) U.S. Cl.

CPC ..... *A47C 7/027* (2013.01); *A47C 7/40* (2013.01)

(58) Field of Classification Search

CPC ..... A47C 7/027; A47C 7/40
USPC ..... 297/285, 296, 452.15, 452.56
See application file for complete search history.

(56) References Cited

U.S. PATENT DOCUMENTS

| | | | |
|---|---|---|---|
| 87,184 | A | 2/1869 | Mattson |
| 546,174 | A | 9/1895 | Menzenhauer |
| 1,982,516 | A | 11/1934 | Holmested |
| 2,414,978 | A | 1/1947 | Richardson |
| D149,798 | S | 6/1948 | Crawford |
| 2,799,323 | A | 7/1957 | Berg et al. |
| D188,843 | S | 9/1960 | Kagan |
| 3,120,407 | A | 2/1964 | Propst |
| 3,137,523 | A | 6/1964 | Karner |
| 3,162,487 | A | 12/1964 | Trotman |
| 3,233,885 | A | 2/1966 | Propst |
| 3,514,156 | A | 5/1970 | Fields |

(Continued)

FOREIGN PATENT DOCUMENTS

| | | | |
|---|---|---|---|
| CA | 2542978 A1 * | 5/2005 | ..... F16F 1/025 |
| DE | 4316057 A1 | 11/1994 | |

(Continued)

OTHER PUBLICATIONS

International Search Report and Written Opinion for International Application No. PCT/US2018/63632 dated Apr. 30, 2019.

(Continued)

*Primary Examiner* — Rodney B White
(74) *Attorney, Agent, or Firm* — Brinks Gilson & Lione

(57) ABSTRACT

A body support structure including a plurality of spaced apart support members defining a first surface and a plurality of spaced apart base portions defining a second surface. A plurality of connectors connects each base portion with the at least the two adjacent support members. In one embodiment, a body support structure includes a first plurality of spaced apart first support members and a second plurality of spaced apart second support members arranged in a checkboard pattern.

25 Claims, 25 Drawing Sheets

(56) References Cited

U.S. PATENT DOCUMENTS 3,565,482 A 2/1971 Blodee
3,669,499 A 6/1972 Semplonius et al.
3,877,750 A 4/1975 Scholpp
4,088,367 A 5/1978 Atkinson et al.
4,143,916 A 3/1979 Trotman et al.
4,205,880 A 6/1980 Trotman et al.
4,337,931 A 7/1982 Mundell et al.
4,399,574 A 8/1983 Shuman
4,418,958 A 12/1983 Watkin
4,502,731 A 3/1985 Snider
4,567,615 A 2/1986 Fanti
4,585,272 A 4/1986 Ballarini
4,647,109 A 3/1987 Christophersen et al.
4,660,887 A 4/1987 Fleming et al.
4,658,807 A 8/1987 Swain
4,713,854 A 12/1987 Graebe
4,856,846 A 8/1989 Lohmeyer
4,892,356 A 1/1990 Pittman
4,895,091 A 1/1990 Emali et al.
4,913,493 A 4/1990 Heidmann
4,962,964 A 10/1990 Snodgrass
5,015,038 A 5/1991 Mrotz, III
5,022,709 A 6/1991 Marchino
5,024,485 A 6/1991 Berg et al.
5,029,939 A 7/1991 Smith et al.
5,102,196 A 4/1992 Kaneda et al.
5,154,485 A 10/1992 Fleishman
5,282,285 A 2/1994 de Gelis et al.
5,288,127 A 2/1994 Berg et al.
D346,073 S 4/1994 Hamelink
5,320,410 A 6/1994 Faiks
5,326,155 A 7/1994 Wild
5,340,197 A 8/1994 Vogtherr
5,403,067 A 4/1995 Rajaratnam
5,518,294 A 5/1996 Ligon, Sr. et al.
5,664,835 A 9/1997 Desanta
5,747,140 A * 5/1998 Heerklotz ..... A47C 27/144 297/452.56 X
5,774,911 A 7/1998 Stùbe et al.
5,871,258 A 2/1999 Battey et al.
5,934,758 A 8/1999 Ritch et al.
5,951,109 A 9/1999 Roslund, Jr. et al.
D438,392 S 3/2001 Lucci et al.
6,334,650 B1 1/2002 Chine-Chuan
6,357,826 B1 3/2002 Gabas et al.
6,409,268 B1 6/2002 Cvek
6,412,869 B1 7/2002 Pearce
6,439,661 B1 8/2002 Bräuning
D462,534 S 9/2002 Grazioli
6,477,727 B1 * 11/2002 Fromme ..... A47C 23/002 267/81
6,523,898 B1 2/2003 Ball
6,568,760 B2 5/2003 Davis
6,598,251 B2 7/2003 Habboub et al.
6,626,497 B2 9/2003 Nagamitsu
6,669,292 B2 12/2003 Koepke
6,669,301 B1 12/2003 Funk
6,679,553 B2 1/2004 Battey et al.
6,679,557 B2 1/2004 Craft et al.
6,701,550 B2 3/2004 Baeriswyl
6,726,285 B2 4/2004 Caruso et al.
6,767,060 B2 7/2004 Craft et al.
6,793,289 B2 9/2004 Kuster et al.
6,820,933 B2 11/2004 Fereira Da Silva
6,826,791 B2 * 12/2004 Fromme ..... A47C 23/002 267/103
6,901,617 B2 6/2005 Sprouse, II et al.
6,910,736 B2 6/2005 White
6,986,549 B2 1/2006 Kniese
7,032,971 B2 4/2006 Williams
7,059,682 B2 6/2006 Caruso et al.
D527,557 S 9/2006 Reimers
7,165,811 B2 1/2007 Bodnar et al.
D546,574 S 7/2007 Kaloustian
7,237,841 B2 7/2007 Norman et al.
7,320,503 B2 1/2008 Eysing
7,425,037 B2 9/2008 Schmitz et al.
7,441,758 B2 10/2008 Coffield
7,455,365 B2 11/2008 Caruso et al.
7,461,892 B2 12/2008 Bajic et al.
7,472,962 B2 1/2009 Caruso et al.
D594,669 S 6/2009 Asano
D595,072 S 6/2009 Su
7,568,768 B1 8/2009 Tsai
7,604,298 B2 10/2009 Peterson et al.
7,604,299 B2 10/2009 Su
7,648,201 B2 1/2010 Eysing
D612,642 S 3/2010 Cassaday
7,686,395 B2 3/2010 Piretti
7,695,069 B2 4/2010 Prust
7,740,321 B2 6/2010 Brill
7,794,022 B2 9/2010 Caruso et al.
7,798,573 B2 9/2010 Pennington et al.
7,857,388 B2 12/2010 Bedford et al.
7,874,619 B2 1/2011 Harley
7,878,591 B2 2/2011 Walker
7,878,598 B2 2/2011 Oda
7,896,438 B2 3/2011 Whelan et al.
7,909,402 B2 3/2011 Chu et al.
7,926,879 B2 4/2011 Schmitz et al.
7,931,257 B2 4/2011 Vandereit
D637,839 S 5/2011 Piretti
D638,641 S 5/2011 Piretti
D642,819 S 8/2011 Piretti
D643,654 S 8/2011 Piretti
D649,804 S 12/2011 Keller et al.
D650,616 S 12/2011 Piretti
D652,224 S 1/2012 Ferrier
8,087,727 B2 1/2012 Parker et al.
8,157,329 B2 4/2012 Masoud
D660,611 S 5/2012 Barile
8,172,332 B2 5/2012 Masunaga
8,185,988 B2 * 5/2012 Wieland ..... A47C 23/05 5/247
8,191,970 B2 6/2012 Igarashi
8,251,448 B2 8/2012 Machael
8,256,043 B2 * 9/2012 Fromme-Ruthmann ..... A47C 7/027 5/247
8,272,691 B2 9/2012 Hsuan-Chin
8,276,986 B2 10/2012 Kim
8,282,169 B2 10/2012 Schmitz et al.
8,282,172 B2 10/2012 Schmitz
D673,395 S 1/2013 Piretti
8,414,073 B2 4/2013 Schmitz et al.
8,449,037 B2 5/2013 Behar
D688,055 S 8/2013 Baldanzi et al.
D688,061 S 8/2013 Giugiaro
8,528,980 B1 9/2013 Hsiao
8,540,315 B2 9/2013 Piretti
8,590,978 B2 11/2013 Jaranson et al.
8,622,472 B2 1/2014 Rajaratnam
8,745,783 B2 6/2014 Jansen
8,919,880 B2 12/2014 Bellingar et al.
8,939,507 B2 1/2015 Thomaschewski et al.
8,967,726 B2 3/2015 Schmitz et al.
8,998,339 B2 4/2015 Peterson
9,010,859 B2 4/2015 Battey
9,022,475 B2 5/2015 Brncick et al.
9,033,421 B2 5/2015 Wilkinson
D731,833 S 6/2015 Fifield et al.
9,114,880 B2 8/2015 Guering
9,144,311 B2 9/2015 Romero
9,185,985 B2 11/2015 Bellingar et al.
9,186,290 B2 11/2015 Fowler
9,211,014 B2 12/2015 Schmitz et al.
9,237,811 B1 1/2016 Cho
9,326,613 B2 5/2016 Cvek
9,332,851 B2 5/2016 Machael et al.
9,414,681 B2 8/2016 Bellingar et al.
9,486,081 B2 11/2016 Sander et al.
9,504,326 B1 11/2016 Cartis et al.
9,533,457 B2 * 1/2017 Haimoff ..... A47C 7/027
D779,251 S 2/2017 Beyer et al.

(56) References Cited

U.S. PATENT DOCUMENTS

| | | | | |
|---|---|---|---|---|
| 9,578,968 | B2 | 2/2017 | Masunaga | |
| 9,596,941 | B1 | 3/2017 | Romero | |
| 9,913,539 | B2 | 3/2018 | Potrykus | |
| 10,016,059 | B2 | 7/2018 | Leonard et al. | |
| 10,064,493 | B2 | 9/2018 | Machael | |
| 10,219,627 | B2 * | 3/2019 | Deevers | A47C 7/027 |
| 10,357,955 | B2 | 7/2019 | Ziolek | |
| 2001/0008955 | A1 | 7/2001 | Garth | |
| 2002/0021040 | A1 | 2/2002 | Caruso et al. | |
| 2002/0093233 | A1 | 7/2002 | Chu | |
| 2002/0190564 | A1 | 12/2002 | Coffield | |
| 2003/0107252 | A1 | 6/2003 | Kinoshita | |
| 2004/0007910 | A1 | 1/2004 | Skelly | |
| 2004/0100139 | A1 | 5/2004 | Williams | |
| 2004/0140701 | A1 | 7/2004 | Schmitz | |
| 2004/0183348 | A1 | 9/2004 | Kniese | |
| 2004/0195882 | A1 | 10/2004 | White | |
| 2004/0256899 | A1 | 12/2004 | Moore et al. | |
| 2005/0001464 | A1 | 1/2005 | Caruso | |
| 2005/0062323 | A1 | 3/2005 | Dicks | |
| 2005/0104428 | A1 | 5/2005 | Walker et al. | |
| 2006/0033369 | A1 | 2/2006 | Eysing | |
| 2006/0103208 | A1 | 5/2006 | Schmitz | |
| 2006/0181126 | A1 | 8/2006 | Eysing | |
| 2006/0255635 | A1 | 11/2006 | Iijima et al. | |
| 2007/0262634 | A1 | 11/2007 | Brill | |
| 2009/0085388 | A1 | 4/2009 | Parker | |
| 2010/0117433 | A1 | 5/2010 | Cassaday | |
| 2012/0025574 | A1 | 2/2012 | Wilkinson et al. | |
| 2012/0061988 | A1 | 3/2012 | Jaranson et al. | |
| 2012/0200018 | A1 * | 8/2012 | Paz | A47C 23/002 267/94 |
| 2013/0221714 | A1 | 8/2013 | Fowler | |
| 2013/0221724 | A1 | 8/2013 | Fowler | |
| 2013/0257125 | A1 | 10/2013 | Bellingar et al. | |
| 2014/0070587 | A1 | 3/2014 | Aldricj et al. | |
| 2014/0110983 | A1 | 4/2014 | Sander et al. | |
| 2014/0117732 | A1 | 5/2014 | Bachar | |
| 2014/0152064 | A1 | 6/2014 | Sander et al. | |
| 2014/0159450 | A1 | 6/2014 | Guering | |
| 2014/0159455 | A1 | 6/2014 | Thomaschewski et al. | |
| 2014/0183914 | A1 | 7/2014 | Cvek | |
| 2014/0265493 | A1 | 9/2014 | Machael | |
| 2015/0265058 | A1 | 9/2015 | Igarashi | |
| 2016/0029801 | A1 | 2/2016 | Potrykus | |
| 2016/0037931 | A1 | 2/2016 | Wu | |
| 2016/0100691 | A1 | 4/2016 | Masunaga | |
| 2016/0135603 | A1 | 5/2016 | Chan | |

FOREIGN PATENT DOCUMENTS

| | | | | |
|---|---|---|---|---|
| DE | 102007054257 | A1 | 5/2009 | |
| DE | 102008009509 | A1 | 8/2009 | |
| EP | 2110052 | B1 | 10/2009 | |
| FR | 2840786 | A1 | 12/2003 | |
| JP | 2009268780 | A | 11/2009 | |
| JP | 5242088 | | 7/2013 | |
| WO | WO 96/104003 | A1 | 5/1996 | |
| WO | WO 01/74199 | A1 | 10/2001 | |
| WO | WO 2007/067997 | A1 | 6/2007 | |
| WO | WO 01/98105 | A1 | 12/2007 | |
| WO | WO-2008148992 | A1 * | 12/2008 | F16F 1/027 |
| WO | WO2014/047242 | A1 | 3/2014 | |
| WO | WO 2017/135831 | A1 | 8/2017 | |
| WO | WO 2019/064321 | A1 | 4/2019 | |

OTHER PUBLICATIONS

International Search Report and Written Opinion for International Application No. PCT/US2017/053409 dated Dec. 20, 2017 (9 pages).

* cited by examiner

COMPLIANT SEATING STRUCTURE

This application is a continuation of U.S. application Ser. No. 15/715,496, filed Sep. 26, 2017, which claims the benefit of U.S. Provisional Application 62/401,415, filed Sep. 29, 2016, the entire disclosures of which are hereby incorporated herein by reference.

FIELD OF THE INVENTION

The present application relates generally to a compliant seating structure, which may be incorporated for example into a seat or backrest of a chair or other body supporting member.

BACKGROUND

Body supporting structures, including for example, office chairs, vehicular and aircraft seating, sofas, beds and other pieces of furniture, are typically configured with internal or external support frames having hard contact points. For example, seats and backrests may be made with a resilient membrane or shell structure, which are typically supported by a rigid, peripheral frame surrounding the membrane or shell structure. The frame presents hard contact points, precludes flexing of the backrest or seat at the periphery thereof, and may also prevent twisting, or torsional movement, about a longitudinal axis of the backrest or seat. In other chairs, the backrest or seat may be configured with a rigid, central spine allowing for some twisting about a longitudinal axis, but with the connection of the spine to the body support member producing hard, contact points. In yet another type of chair, the backrest or seat may be configured with a rigid shell, which supports a cushion or other resilient body support member.

In all of these conventional seating structures, the rigidity of the frame or shell limits the ability of the body support structure to flex and support the body of the user as the user moves within the seating structure. Moreover, the hard contact points, or lack of flexibility at the edge of the seating structure, combined with the restrictions imposed by the frame, spine and/or rigid shell, limit the comfort and ergonomic responsiveness of the seating structure.

SUMMARY

The present invention is defined by the following claims, and nothing in this section should be considered to be a limitation on those claims.

In one aspect, one embodiment of a seating structure includes a shell having a central portion, opposite outer peripheral edges laterally spaced from opposite sides of the central portion, and at least one biasing array disposed between each of the opposite sides of the central portion and a respective laterally spaced outer peripheral edge. Each of the biasing arrays includes a plurality of spaced apart support members and at least one connector connecting adjacent support members within each array. The connectors provide for relative movement between the support members, and in one embodiment define pivot joints, for example living hinges, such that the support members are pivotable about the connectors relative to each other and/or to the central portion.

In one embodiment, the biasing array includes a plurality of biasing arrays, with at least one connector connecting adjacent biasing arrays. In one embodiment, the connector connecting the adjacent support members and the connector connecting adjacent biasing arrays is integrally formed as a single connector.

In another aspect, one embodiment of a seating structure includes a first load bearing shell having a central portion, opposite outer peripheral edges laterally spaced from opposite sides of the central portion, and a biasing array disposed between each of the opposite sides of the central portion and a respective laterally spaced outer peripheral edge. The biasing arrays each includes a plurality of laterally extending and longitudinally spaced support members and a plurality of connectors connecting the support members to the central portion. A second body-supporting shell is connected to the outer peripheral edges of the first load bearing shell. The first and second shells define an open space there between. Each of the opposite outer peripheral edges is independently deflectable in a fore and aft direction in response to a load being applied to the second body supporting shell.

In yet another aspect, one embodiment of a seating structure includes a first load bearing shell having a central portion, opposite outer peripheral edges laterally spaced from opposite sides of the central portion, and at least one biasing array disposed between each of the opposite sides of the central portion and a respective laterally spaced outer peripheral edge. Each of the biasing arrays includes a plurality of spaced apart support members and at least one connector connecting adjacent support members within each array. A second body-supporting shell is connected to the outer peripheral edges of the first shell. The first and second shells define an open space there between. Each of the opposite outer peripheral edges is independently deflectable in a fore and aft direction in response to a load being applied to the second body-supporting shell.

In yet another aspect, a seating structure includes a support frame having a pair of laterally spaced apart frame members defining an open space there between. A first load bearing member includes a pair of laterally spaced apart load bearing segments having outer ends coupled to the spaced apart frame members. A second body-supporting member includes a plurality of support segments and connectors connecting the support segments. The connectors define pivot joints between the support segments. The plurality of support segments includes a pair of outboard support segments each having an outer free end spaced apart in a fore and aft direction from the outer ends of the load bearing segments. The outer free ends of the support segments are moveable toward and away from the outer ends of the load bearing segments and the frame members. A plurality of links extends between each of the load bearing segments and at least two of the support segments.

In yet another aspect, a method of supporting a body of a user on a seating structure includes applying a load with the body of the user to a body supporting shell and transferring at least a portion of the load from the body supporting shell to outer peripheral edges of a load bearing shell laterally spaced from a central portion of the load bearing shell. At least one biasing array is disposed between the outer peripheral edges and the central portion. The at least one biasing array includes a plurality of spaced apart support members and at least one connector connecting adjacent support members within each array. The method further includes transmitting a portion of the load transferred to the outer peripheral edges to the central portion through the at least one biasing array, wherein the transmitting of the portion of the load to the central portion includes moving the adjacent support members relative to each other about the at least one connector. In one embodiment, the adjacent support members are pivoted relative to each other.

The various embodiments of seating structures and methods provide significant advantages over other seating structures and methods. For example and without limitation, the seating structures provide a soft outer peripheral edge, which allows the user to bear against and flex the peripheral edge without encountering a hard contact point. The peripheral edges are independently flexible and responsive to loads being applied to the backrest. In addition, the central portion of various embodiments provides an anchor or support structure about which the various biasing arrays may be arranged. The central support and biasing arrays may be tuned to optimize and vary support in various desired locations, for example and without limitation the lumbar, thoracic and pelvic regions of a backrest, or the thigh and buttock regions of a seat. In various embodiments, the dual shell structure allows for independent tuning of both the load bearing shell and the body supporting shell.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 2:
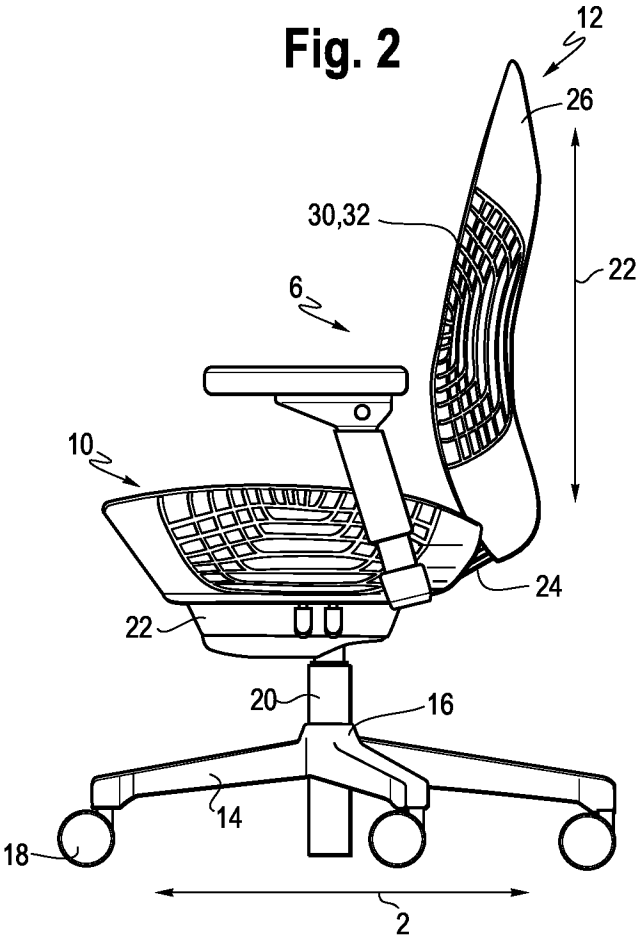
FIG. 2 is a side view of the office chair shown in FIG. 1.
Figure 1:
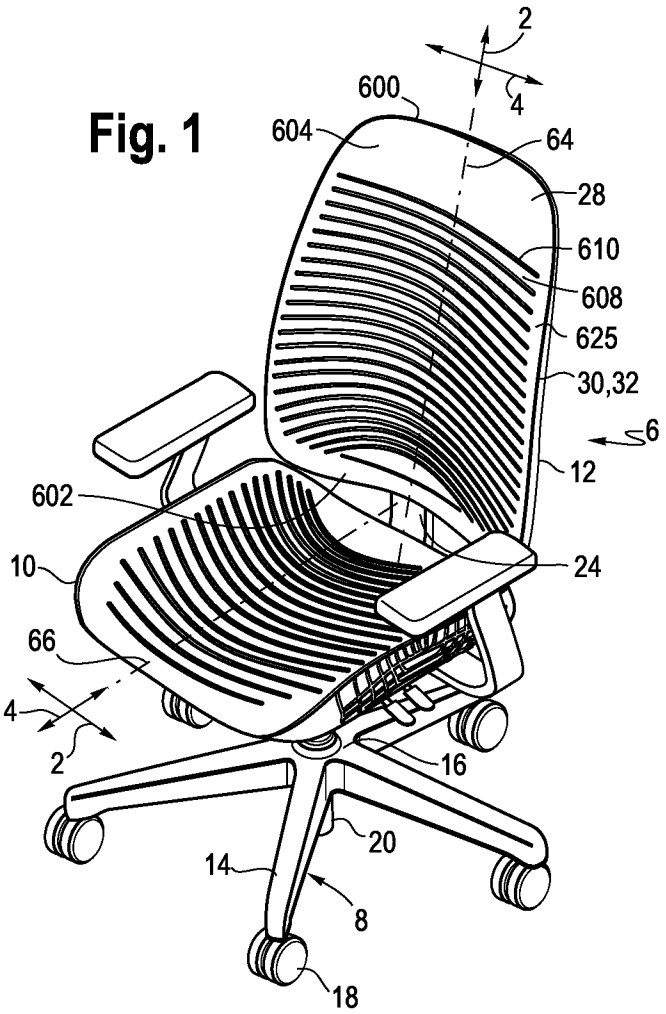
FIG. 1 is a perspective view of one embodiment of an office chair incorporating a compliant seating structure.

It should be understood that the term "plurality," as used herein, means two or more. The term "longitudinal," as used herein means of or relating to a length or lengthwise direction 2, for example a direction running from a top to bottom of a backrest, or a front to back of a seat, and vice versa (bottom to top and back to front). The term "lateral," as used herein, means situated on, directed toward or running in a side-to-side direction 4 of the backrest or seat. The term "coupled" means connected to or engaged with whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," and variations or derivatives thereof, refer to the orientations of the exemplary seating structure as shown in FIGS. 1 and 2. The phrase "seating structure" refers to a body supporting structure, including without limitation office furniture, home furniture, outdoor furniture and vehicular seating, including automotive, airline, marine and passenger train seating, and may include without limitation beds, chairs, sofas, stools, and other pieces of furniture or types of body supporting structures.

Seating Structure:

Referring to the drawings, FIGS. 1 and 2 show one embodiment of a seating structure configured as an office chair 6 having a base 8, a seat 10 and a backrest 12. The base includes a leg assembly having a plurality of support legs 14 (shown as five) extending from a central hub 16. A distal end of each support leg includes a floor engaging member 18, shown as a caster in one embodiment. Other floor engaging members may include for example and without limitation a glide, foot or pad. A support column 20 is supported by and extends upwardly from the central hub 16. The support column 20 may have a fixed height, or may be height adjustable, for example being configured with a telescopic column having a pneumatic or hydraulic actuation mechanism. A control housing 22, for example a tilt control housing, is supported by an upper end of the support column 20. It should be understood that the phrase "control housing" refers to a housing structure, as well as any tilt mechanism disposed therein. The control housing may include a tilt mechanism that controls the movement of one or both of the seat and backrest in a fore and aft and/or up and down direction. The backrest 12 includes a support member 24 that extends forwardly from a lower portion of the backrest 12 and is coupled to the control housing 20. The seat 10 is supported by the control housing, for example along a central, longitudinally extending axis 66 of the seat.

In one embodiment, one or both of the seat and backrest includes a first, load bearing shell 26 and a second, body-supporting shell 28, each having laterally spaced outer peripheral edges 30, 32, which are joined. The first and second shells are connected along at least the outer peripheral edges and define a generally open space 35 there between, as shown for example in FIGS. 28-30, such that the body supporting shell may deflect into the open spaced toward the load bearing shell in response to a load being applied thereto, for example by the body of a user $L_B$. It should be understood that the various body supporting structures disclosed as a backrest embodiment may also be incorporated into a seat or other body supporting platform such as a bed.

Load Bearing Components:

The first, load bearing shell 26 is made of a relatively thin plastic, for example polypropylene. In other embodiments, the shell may be made of metal, composites, and/or elastomeric materials, and combinations thereof. The load bearing shell 26, which defines a rear surface of the backrest, or bottom surface of the seat, has a central portion 34 extending along a central longitudinal axis of the seat or backrest. The rear surface may be the rearwardmost surface of the backrest exposed to the user, or it may be covered, for example with a fabric or other cover. The central portion 34 has opposite sides 36, which are laterally spaced from the outer peripheral edges 30. The central portion 34 is monolithic in various embodiments, having portions that extend uninterrupted (without any pivot joint) between a bottom and top thereof, so as to provide the central portion with relative rigidity as compared with the adjacent biasing arrays. In other embodiments, the central portion may be replaced, or configured, with an array of support elements and connectors.

At least one biasing array 38 is disposed, or arranged, between each of the opposite sides 36 of the central portion and a respective one 30 of the outer peripheral edges. In one embodiment, shown in FIGS. 1-4, a grouping 38 of a plurality of biasing arrays 70, 170, 270, 370, 470, 570 are disposed between each of the opposite sides 36 and one of the outer peripheral edges 30, at least a portion of which are defined by the biasing arrays. The biasing arrays 70, 170, 270, 370, 470, 570 each include a plurality of spaced apart support members 40, 82, and at least one connector 50 connecting adjacent support members within each array, and connecting adjacent support members to the central portion 34. The connectors, or other pivot joints, are resilient and elastically deformed to allow relative movement between the connected support members and/or central portion.

Figures 5, 5A, 5B, 5C, 5D, 34:
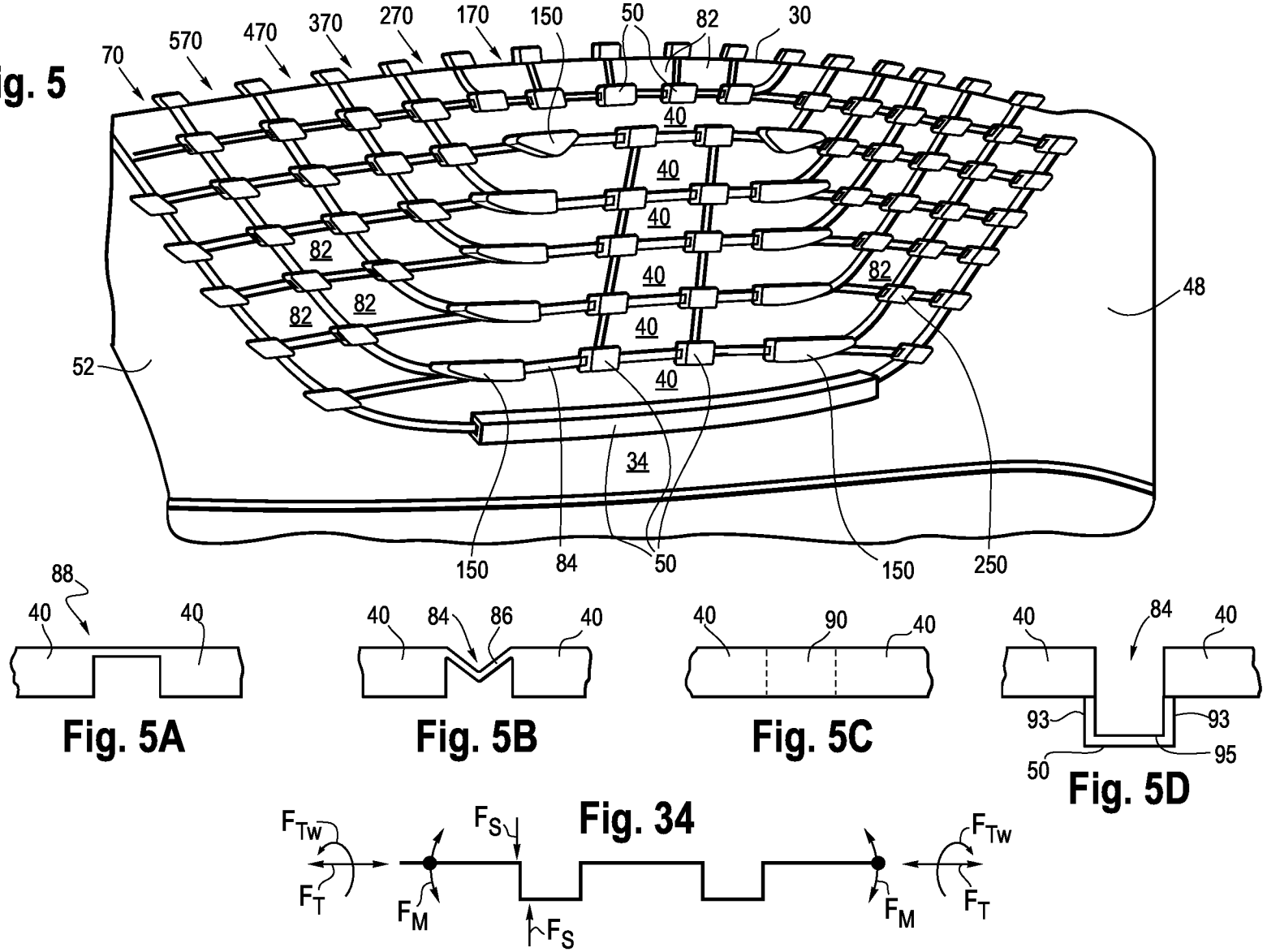
FIG. 5 is partial, front view of a load bearing shell incorporated into the backrest shown in FIG. 3.
FIGS. 5A-D are partial cross sectional views showing alternative configurations of connectors and adjacent support members.
FIG. 34 is a schematic diagram of an exemplary load bearing member with various loads being applied thereto.

For example, and referring to FIG. 34, the array may be compressed and expanded within the surface (e.g., plane) in response to translation forces $F_T$, such that the seating structure exhibits flexibility within the plane of the array, with the understanding that the surface may be curved for example in two directions as a saddle shape, or one direction as a bow shape, such that $F_T$ are tangential to the surface at any particular location. In particular, the connectors deform to provide for the relative expansion/compression. The compression or expansion may take place simultaneously in the longitudinal and/or lateral directions, or in other directions depending on the arrangement of the array including the connectors. The deformation of the connectors may be realized through one or both of the geometry and/or material of the connectors.

The array may also be flexible, or experience bending and or torsion/twisting deformation in response to bending forces $F_M$ and twisting forces $F_{TW}$. The bending and twisting may take place simultaneously about various longitudinal and/or lateral axes (lying within or tangential to the curved surface), or about other tangential axes depending on the arrangement of the array including the connectors. In contrast, the array is relatively stiff, and resists deformation, in response to shear forces $F_S$, applied for example normal or perpendicular to the curved surface.

The phrase "elastic," or "elastically deformable," and variations or derivatives thereof, refers to the ability of a body, e.g., connector, to resist a distorting influence or stress and to return to its original size and shape when the stress is removed. In this way, the connectors preferably do not experience any plastic (e.g., permanent) deformation. The support members and central portion may also experience some elastic deformation, although the primary deformation or deflection, whether translation or pivoting/bending/twisting, is realized by the deformation of the connectors or pivot joints. The phrase "pivot joint" refers to a structure, material or combination thereof between two members that promotes or provides for movement, such as pivoting, between the two members, including for example and without limitation, openings, such as slots or channels, hinges (living and mechanical), scoring or thinning or other lines of weakness, differential material bridges, and other types of expansion joints, pivot joints, and combinations thereof. For example, a series of slots, or a perforation, arranged along a line, whether linear, curved or curvilinear, provides a line of weakness that promotes or provides for pivoting between the connected elements.

Outer surfaces 44 of the support members 40, 82 are flush with an outer surface 46 of the central portion, meaning the edges of adjacent support members 40, 82, and the adjacent edges of the support members 40, 82 and the central portion 34 are flush or at the same level, as shown for example in FIGS. 5A-D, even though the overall shell 26 has a curved, non-planar outer surface. In this way, and notwithstanding the slots, or other pivot joints, formed between the support members, the outer surfaces 44, 46 present a visually and tactilely smooth surface to the user. As shown in the figures, the load bearing shell 26 has an overall saddle shaped outer surface with a convexly shaped outer surface defined along the lateral direction 4, and a concavely shaped outer surface defined along the longitudinal direction 2.

Figure 10B:
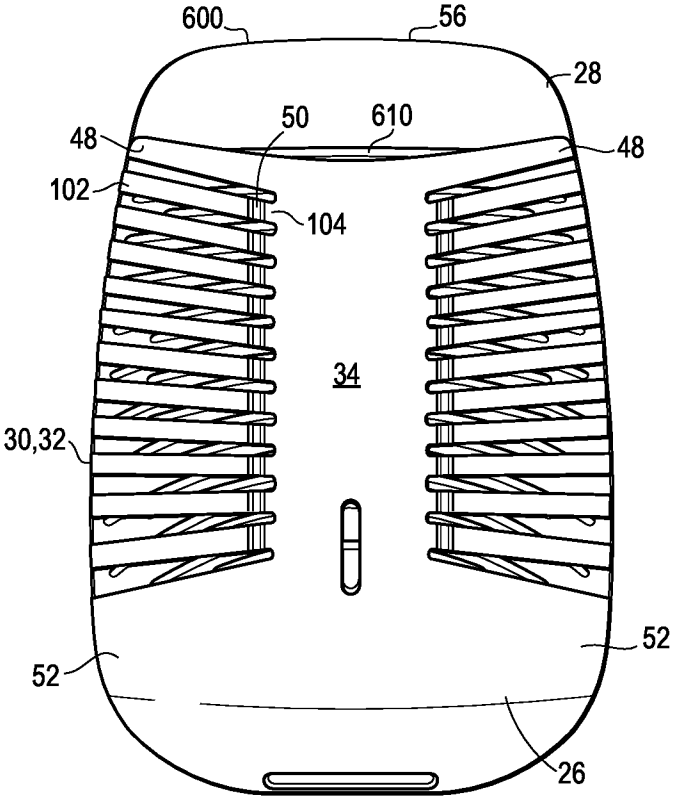
FIGS. 10A and B are rear views of other embodiments of a backrest.
Figure 10A:
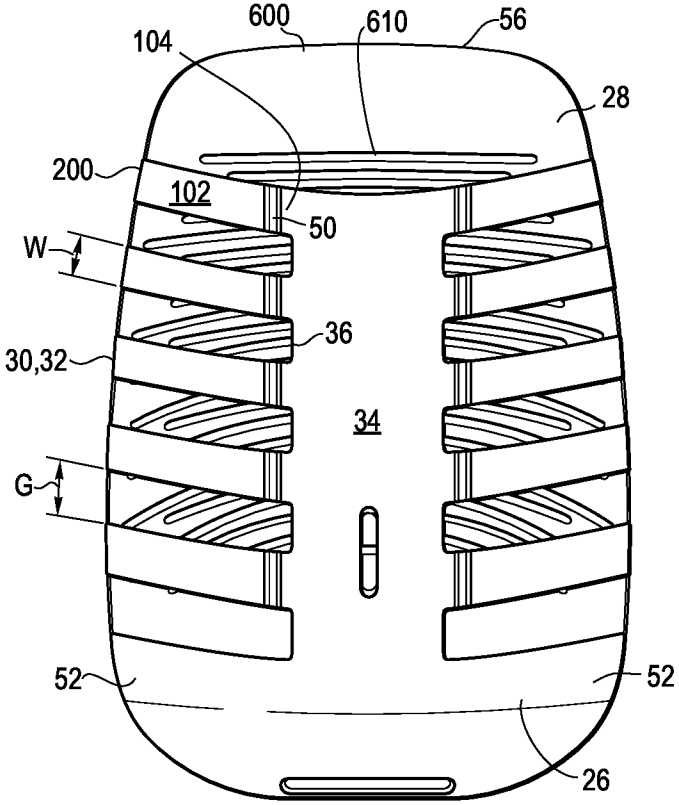

In various embodiments, shown for example in FIGS. 3, 4, 10B, 11B, 13B, 14B and 15B, the load bearing shell 26 includes pairs of first and second arms 48, 52 extending laterally outwardly from opposite ends of the central portion. The central portion 34 and first and second arms 48, 52 define a generally I-shaped member in one embodiment, which is free of any pivot joints or other discontinuities between the arms and central portion and at least a longitudinal portion of the central portion connecting the first and second arms. As shown in the FIGS. 3 and 4, the first arms 48 may have an upwardly concave upper edge 54, with the second shell extending upwardly above the concave edge and having an unsupported free edge 56. Alternatively, the first arms may extend upwardly and be coupled to an upper peripheral edge of the second shell as shown in FIG. 2. In various embodiments, the first arms may be omitted as shown in FIGS. 10A and 12B, or the second arms may be omitted as shown in FIG. 16B.

Figure 33:
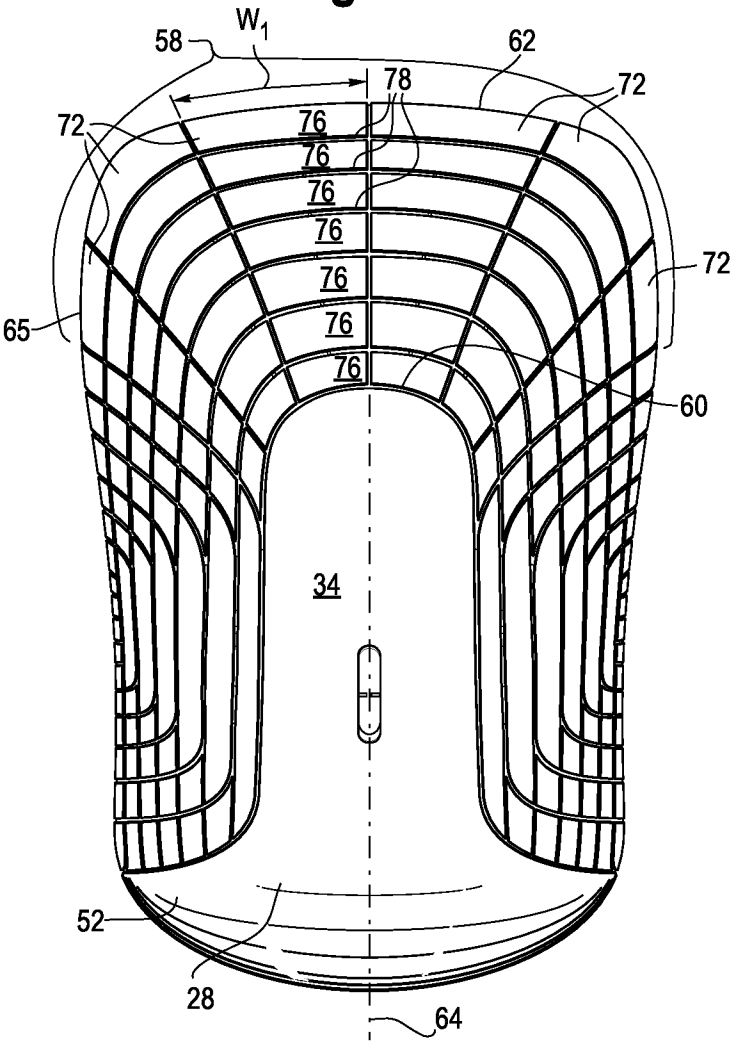
FIG. 33 is a rear view of one embodiment of a backrest.

In yet another embodiment, shown in FIG. 33, the first arms are configured as a grouping 58 of a plurality of biasing arrays 72 (shown as six (FIG. 33)) arranged between an upper end portion 60 of the central portion and an upper peripheral edge 62 of the shell, which may include upper portions 65 of the outer peripheral edges. Each biasing array 72 extends radially from the upper end portion 60, which has a curved perimeter. The arrays 72 are symmetrically arranged on either side of the axis 64.

In one embodiment, each biasing array 72 is configured as a linear array of support members 76, with the width $W_1$ of the support members 76 progressively increasing from the central portion 34 to the upper peripheral edge 62, with the array 72 thus being generally wedge shaped, although not terminating at a point along the end portion 60. The adjacent support members 76 within each array are bounded or separated by a pivot joint, configured in one embodiment as an opening such as a slot 78 or channel and connectors 50. The pivot joints may alternatively be configured as scoring, a thinning of material or a different material bridging the support members. Support members of adjacent arrays may also be bounded or joined by pivot joints, including connectors. The support members adjacent to the central portion may also be joined thereto with connectors, which define pivot joints.

Referring again to FIGS. 1-4, the grouping 38 of the plurality of biasing arrays includes a plurality of laterally spaced, and laterally opening, U-shaped arrays 70, 170, 270, 370, 470, 570 of support members. Each U-shaped array 70, 170, 270, 370, 470, 570 includes an elongated longitudinal support member 40 extending generally in the longitudinal direction 2, and at least one auxiliary support member 82 extending between each end of the longitudinal member 40 and the outer peripheral edge 30. The support elements 82 adjacent the outer peripheral edge may be directly connected to a body-supporting component, or may be connected thereto with connectors 50, as shown in FIG. 5.

Figure 4:
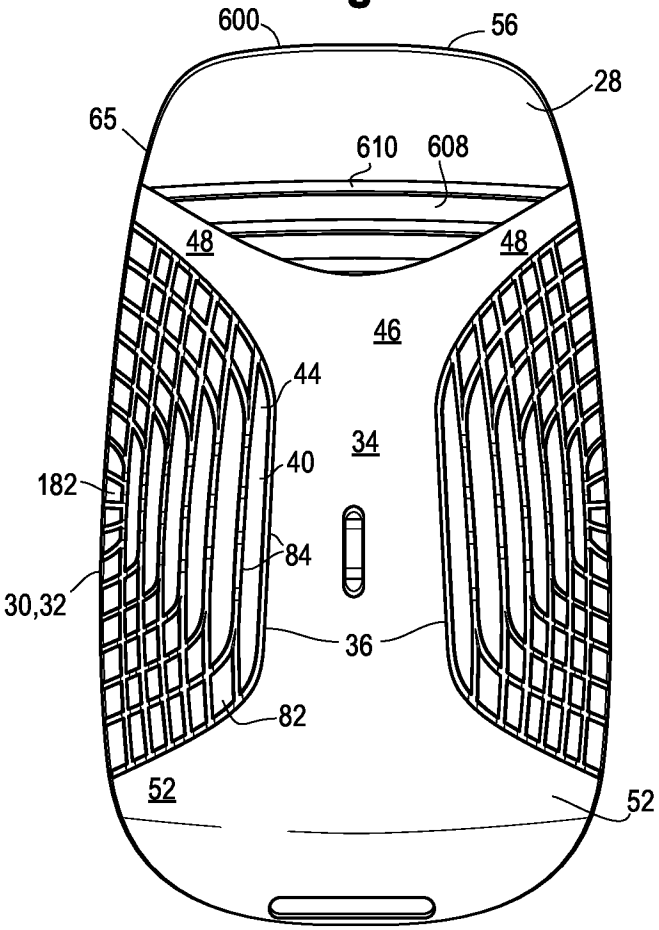
FIG. 4 is a rear view of the backrest shown in FIG. 3.
Figure 3:
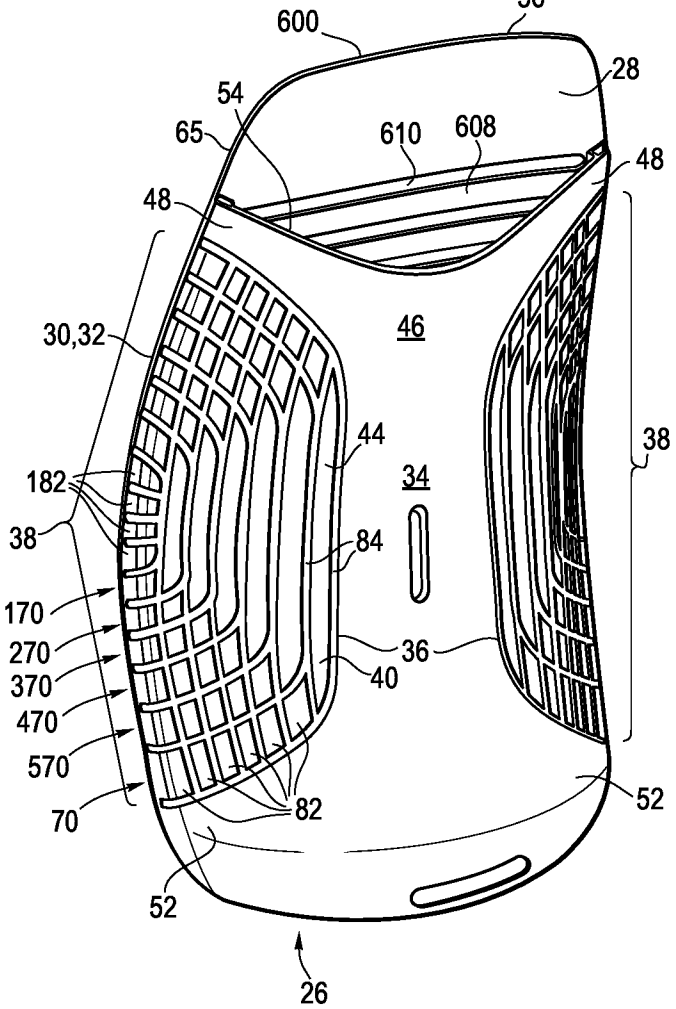
FIG. 3 is a rear, perspective view of one embodiment of a backrest.

In one embodiment, for example and without limitation, six U-shaped arrays are arranged on each side of the central portion as shown in FIGS. 3 and 4. In one embodiment, an inner most U-shaped array 70 (sixth) is nested along the peripheral edges 36 of the central portion 34 and the first and second arms 48, 52, with the U-shaped array having six auxiliary support members 82 disposed at each end of the longitudinal member 44. The remaining U-shaped arrays 570, 470, 370, 270, 170 (fifth through first) are progressively nested within adjacent U-shaped arrays, with a corresponding reduction in the number of auxiliary support members 82 (5, 4, 3, 2 and 1) arranged along each end thereof. Four support members 182 are arranged or nested within the first, outermost U-shaped array 170 along the outer peripheral edge 30.

Figure 6:
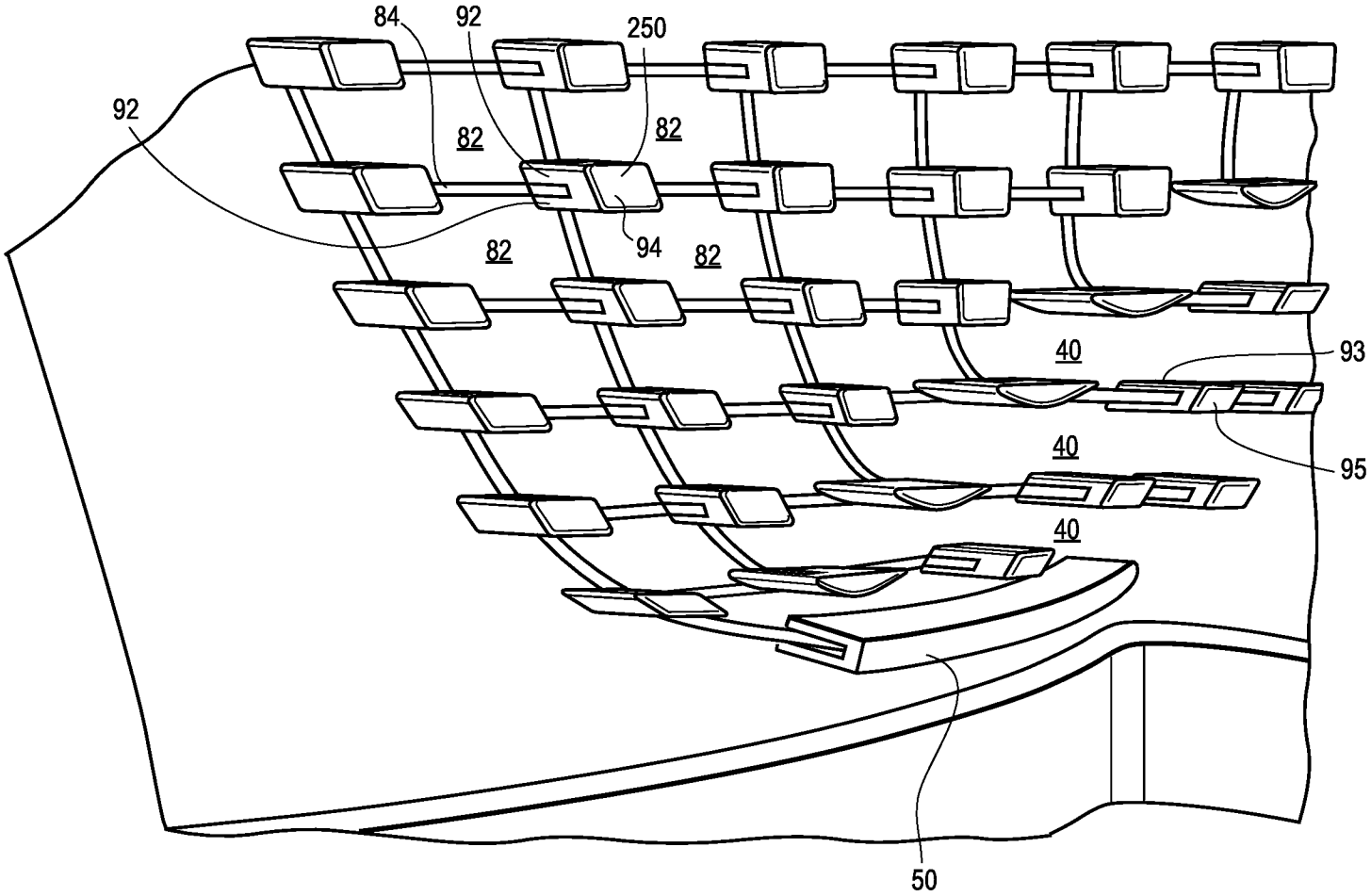
FIG. 6 is an enlarged, partial view of the load bearing shell shown in FIG. 5.
Figure 7:
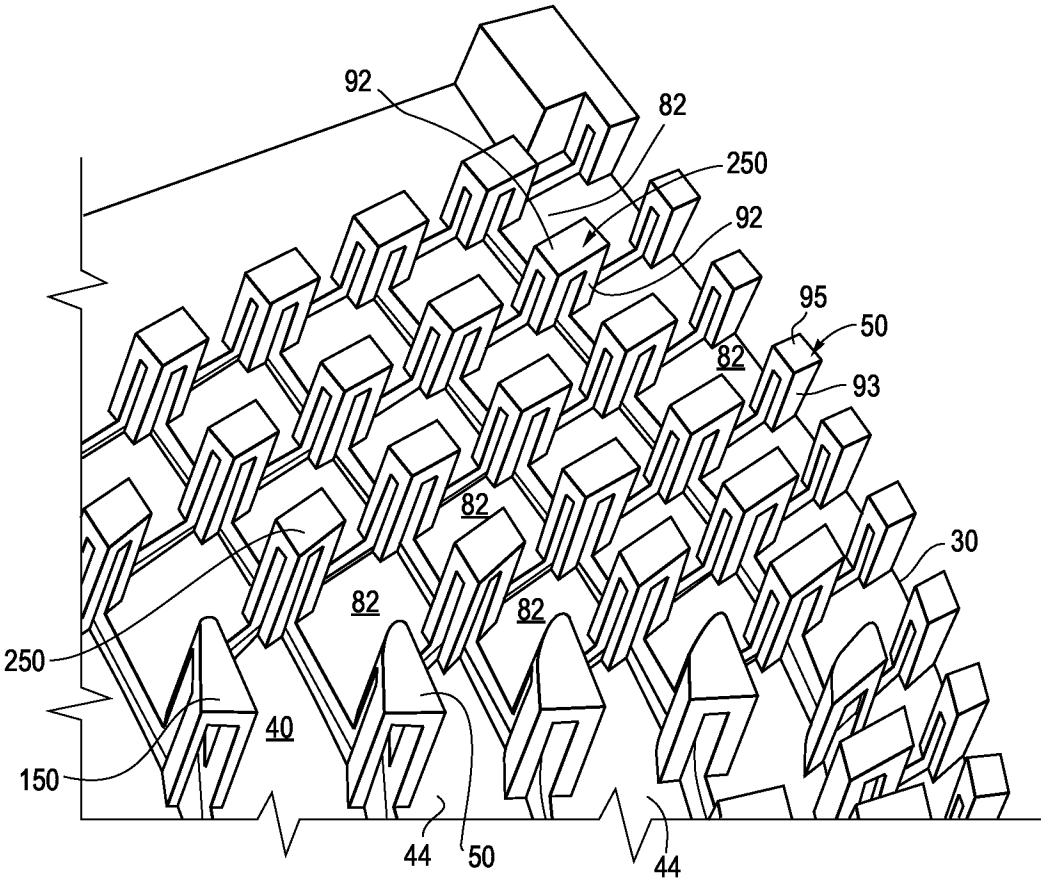
FIG. 7 is another enlarged, partial view of the load bearing shell shown in FIG. 5.

Referring to FIGS. 5-7, which illustrate an interior surface of the first load-bearing shell 26, an elongated connector 50 connects an inner portion of the elongated support member of the sixth array 70 and the central portion 34. Pairs of longitudinally spaced connectors 50 then connect adjacent laterally spaced elongated support 44 of the fifth through first arrays 570, 470, 370, 270, 170. The sides of the adjacent support members form openings 84, such as slots or channels, between the support members, with the connectors 50 and openings 84 in combination forming a pivot joint as shown in FIG. 5D. The connectors 50 are located beneath the slots 84 in one embodiment, or within the slots in other embodiments. Alternatively, the support members may be bounded by other pivot joints, for example scoring of the load bearing shell on one or both sides thereof, or by providing a thinner or different material between the support members. For example, as shown in FIG. 5A, rather than having openings, the support members may be made thicker, with the connectors being the same material, but thinner, or a different material, for example co-molded with the support members. As shown in FIG. 5B, the connectors may be made as a living hinge 86 having an inwardly extending V-shape, or alternatively a W-shape or other serpentine shapes promoting relative movement between the members. Alternatively, as shown in FIG. 5C, the support members 40 (or central portion 34) and connectors 90 may be made the same thickness, with no openings, but of different materials such that the connectors have greater flexibility than the adjacent support members, allowing the adjacent support members to translate (expand or contract) and/or pivot and twist relative to each other. In other embodiments, the connectors may be made with any combination of geometry (living hinge or differential thickness) or differential material properties to provide a flexible pivot joint between stiffer, adjacent support members. The support members may be bounded and connected by combinations of different types of pivot joints, including openings and/or connectors.

In the embodiment shown in FIGS. 5-7, the connectors 50, 150, 250 extend inwardly into the open spaced from the first shell toward the second shell, and are preferably disposed entirely interiorly of the outer surfaces 44, 46 of the load bearing shell. The connectors 50 are generally U-shaped, having a pair of legs 93 joined with a base portion 95, and form a living hinge or pivot joint, allowing adjacent ones of the support members 40, 82, 182 to pivot or bend relative to each other about the joint defined by the connector 50 and open space 84. The connectors 50, 150, 250 also provide for expansion and contraction of the joint, such that the support members may translate relative to each other in both the lateral and longitudinal direction. The connectors 50, 150, 250, in combination with the support members, also allow or provide for twisting or torsional deformation of the array, while limiting or preventing movement, e.g. shear, normal to the surface. As shown in FIGS. 5-7, adjacent arrays are also connected with connectors 150, 250, which may be integrally formed with the connectors connecting adjacent support members within each array. For example, the connectors 250 may be positioned at the junction of four support members, defined by two pairs of adjacent support members within two arrays. As shown in FIG. 7, the connector 250 may have four legs 92 connected to the four support members and a base portion 94 coupling the legs. Again, the connectors, in combination with the openings or lines of weakness between the support members, allow for the various degrees of freedom of movement, including translation (compression/expansion), bending and/or torsion/twisting.

As shown FIGS. 5-7, a connector 150 may also join three support members 40, 82, including the ends of a pair of adjacent elongated support members 40 and one of the auxiliary support members 82. As such, the various pivot joints, or connectors, may be configured to connect any number (2, 3, 4, . . . ) of adjacent support members 40, 82.

Figure 35:
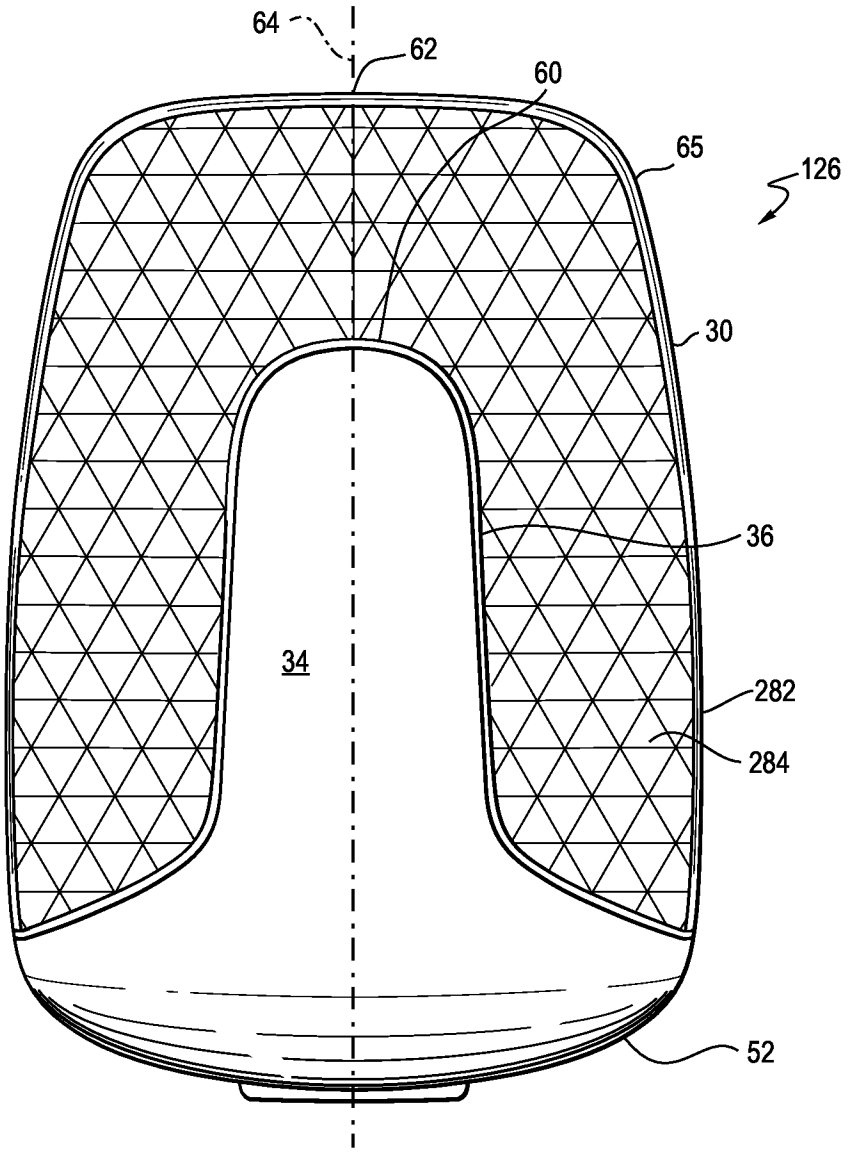
FIG. 35 is a rear view of one embodiment of a backrest.

Referring to the embodiment of FIG. 35, a shell 126 may be configured with a central portion 34, arms 52, and a plurality of biasing arrays configured with a plurality of triangular shaped support members 282. In one embodiment, a plurality of the support members 282 are shaped as equilateral triangles, with other support members, for example adjacent the central portion 34, arms 52 or peripheral edge 30, having other triangular shapes. The support members 282 within each array, and between adjacent arrays, may be connected with various connector members (e.g., 50, 150, 250) as described above. For example, six support members 282, arranged around a node 284, may be connected with a connector having six legs 92. In this embodiment, the biasing arrays extend between the central portion 34 and the peripheral edge 30. The upper portion of the backrest may also be configured without first arms, or with the first arms being configured as a grouping of a plurality of biasing arrays arranged between an upper end portion 60 of the central portion and an upper peripheral edge 62 of the shell, which may include upper portions 65 of the outer peripheral edges. The biasing arrays arranged along the upper portion of the backrest may be symmetrically arranged relative to a central axis 64. Again, the connectors, in combination with the openings or lines of weakness between the support members 282, allow for the various degrees of freedom of movement, including translation (compression/expansion), bending and/or torsion/twisting.

Figure 8:
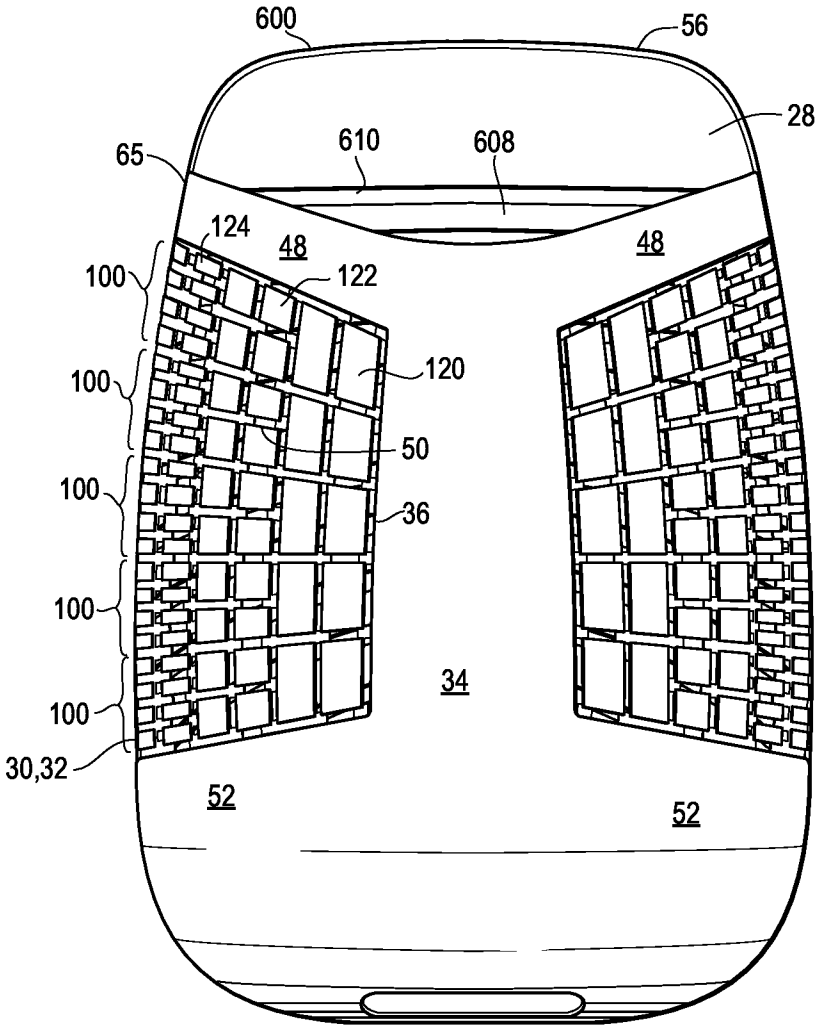
FIG. 8 is a rear view of another embodiment of a backrest.

Now referring to FIGS. 8, 10A and B, 12B, 13B, 14B, 15B, 16B and 28-30, other embodiments of a seating structure are shown. The seating structure includes a plurality of longitudinally spaced, linear arrays 100, 200 extending laterally between one of the opposite sides 36 of the central portion and a respective outer peripheral edge 30. Each of the linear arrays incorporated into the shells shown in FIGS. 10A and B, 12B, 13B, 14B, 15B, and 16B have a pair of support members 102, 104 joined by a single connector 50, which may be configured as a U, V or W shaped living hinge or pivot joint. It should be understood that other geometries (e.g., serpentine, etc.) may also be used as allowing for pivoting or flexing between support members, and between support members and the central portion. As shown, the connector is positioned close to the central portion, with a relatively short support member 104 joined directly to the central portion 34, and an elongated support element 102 extending to the peripheral edge 30. It should be understood that each array may include more than two support members, or a single support member joined directly to the central portion with a connector. In the latter embodiment, shown for example in FIGS. 28-32, an array of support members may include a plurality of laterally extending and longitudinally spaced support members 102, which are not connected to each other in one embodiment, but rather only to the central portion 34 and to the second shell at the outer peripheral edge 30.

The support members 102, 104 may have different widths, and may be spaced apart greater or lesser distances. In the embodiments shown, the width $W_2$ of the respective arrays may be substantially the same as the spaces G there between, although they widths and spaces may be different. The arrays may be oriented in a relative horizontal direction, have a slight upward angle (FIGS. 10A and 16B), or be oriented horizontally in an intermediate region, angled upwardly in an upper region and angled downwardly in a lower region (FIG. 10B, 13B, 14B, 15B). The linear arrays and support members, and in particular the outboard ends thereof, are generally curved forwardly toward the body support shell 28, defining an outer convex surface. In the embodiments of FIGS. 10A and B, 12B, 13B, 14B, 15B, 16B and 28-30, adjacent arrays are generally not connected with connectors, but rather are independently flexible. The free ends of the support members 102, which define the outer peripheral edge 30 of the load bearing shell 26, are joined to the peripheral edge 32 of the body supporting shell 28.

Figure 28:
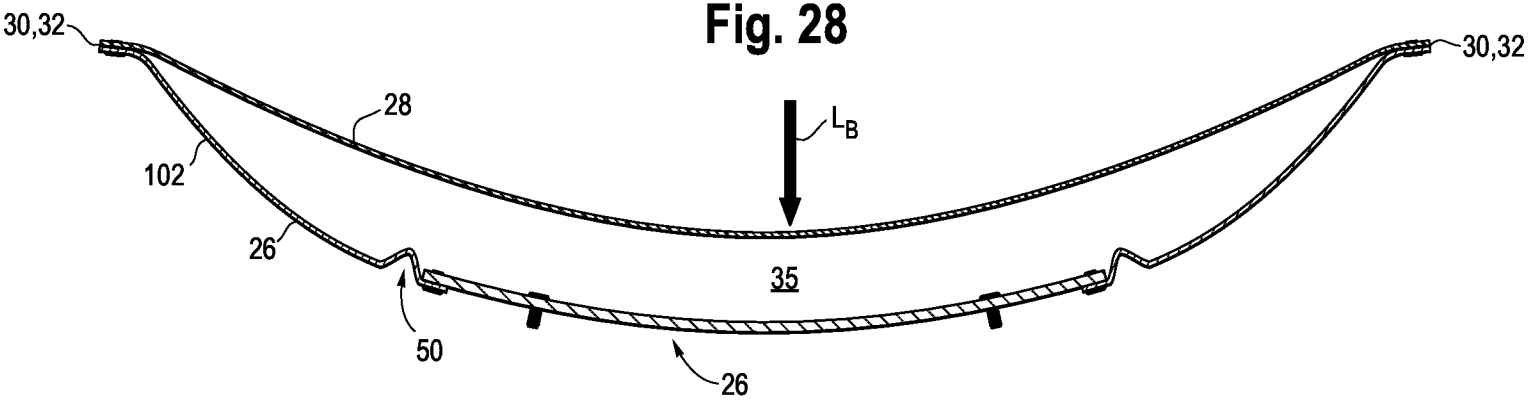
FIG. 28 is a cross-sectional view of another embodiment of a backrest with a central load being applied to a body supporting member.
Figure 29:
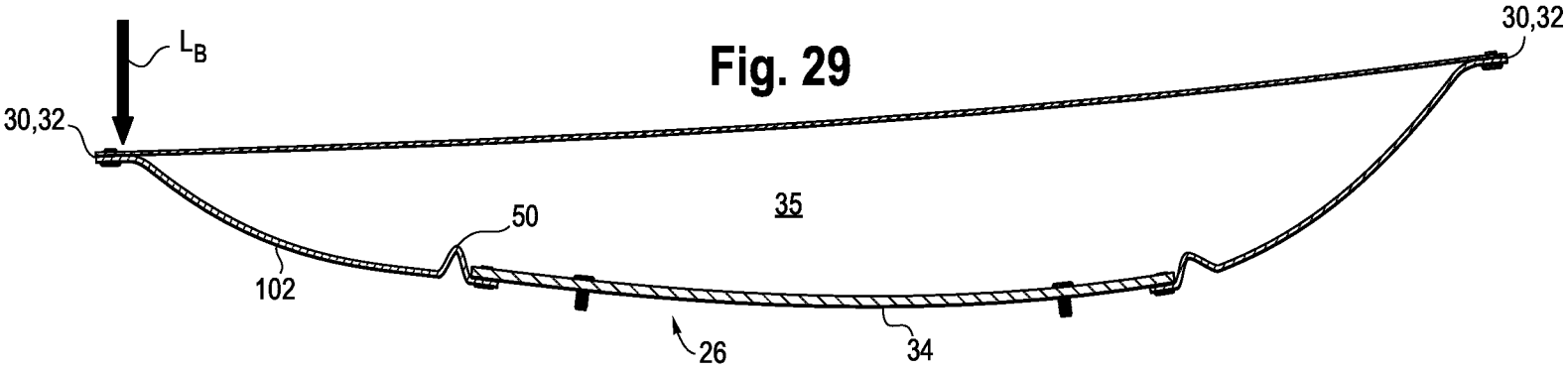
FIG. 29 is a cross-sectional view of the backrest shown in FIG. 28 with an asymmetric side load being applied to a body supporting member.
Figure 30:
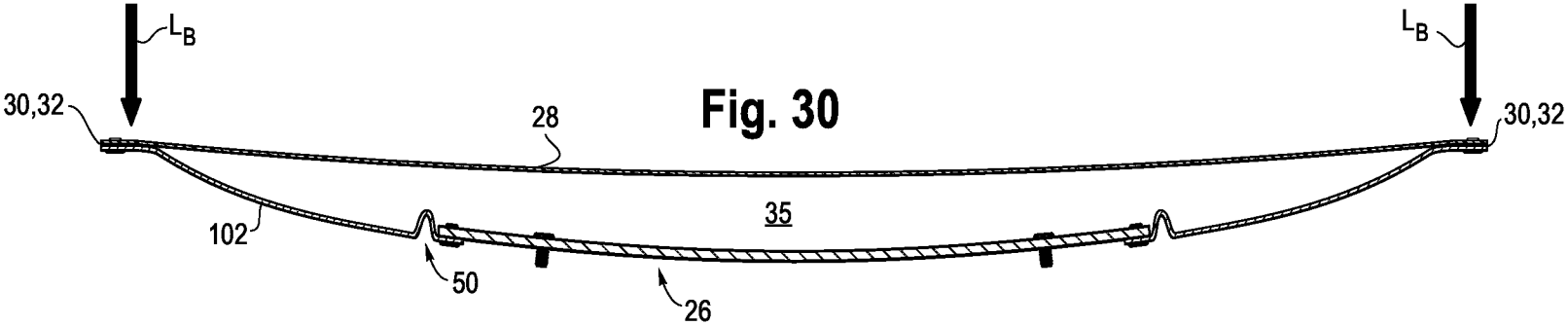
FIG. 30 is a cross-sectional view of the backrest shown in FIG. 28 with a distributed load being applied to a body supporting member.

Referring to FIGS. 28-30, a plurality of beams may each be configured as a rear support member having a central portion 34, which may be mounted to a frame or base or be integrally formed as a central support. Each beam further includes outer segments, or support members 102, joined to the central portion with a pivot joint, for example connectors 50, shown as a living hinge, which allows the support members to pivot relative to the central portion. In addition, the support members may elastically deflect or bend, as shown in FIG. 30. The central portion 34 may also bend or deflect in response to a load being applied thereto.

Figure 14C:
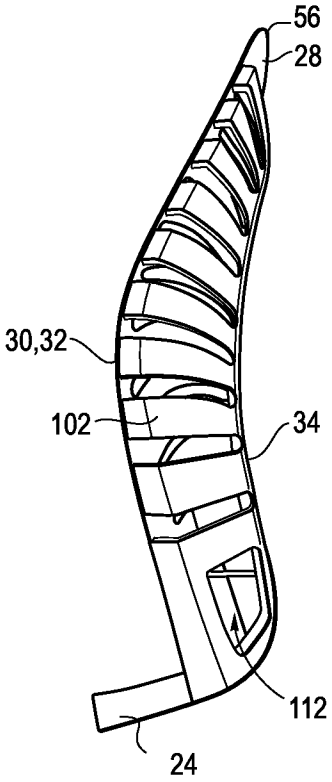
FIGS. 14A, B and C are front, rear and side views of another embodiment of a backrest.
Figure 14B:
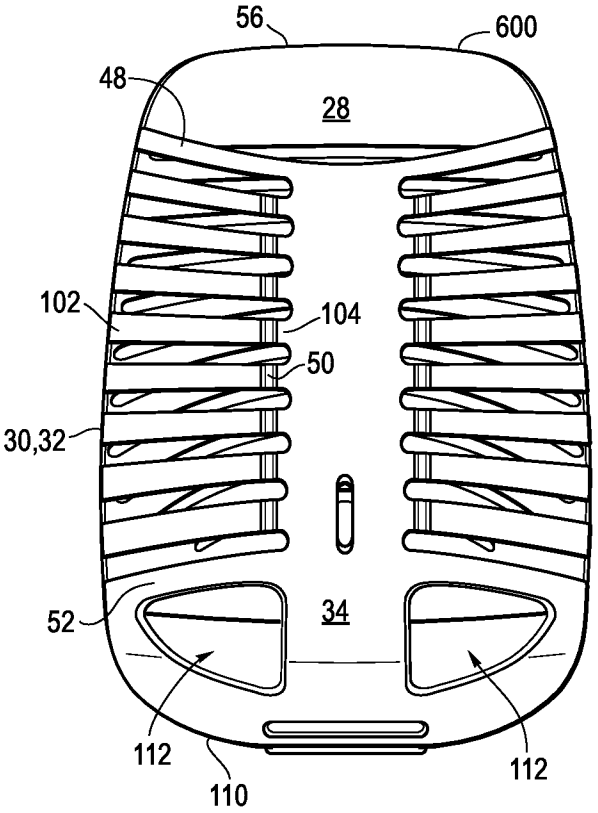
Figure 15C:
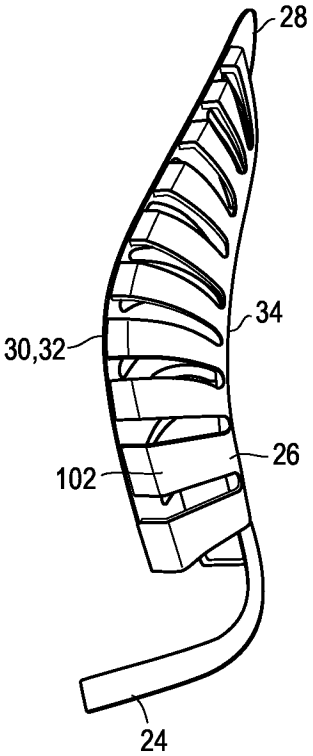
FIGS. 15A, B and C are front, rear and side views of another embodiment of a backrest.
Figure 15B:
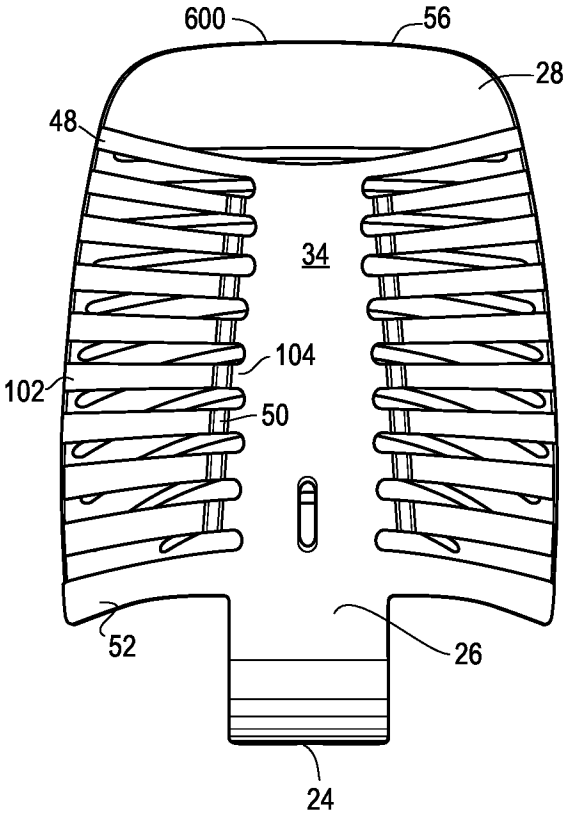
Figure 16C:
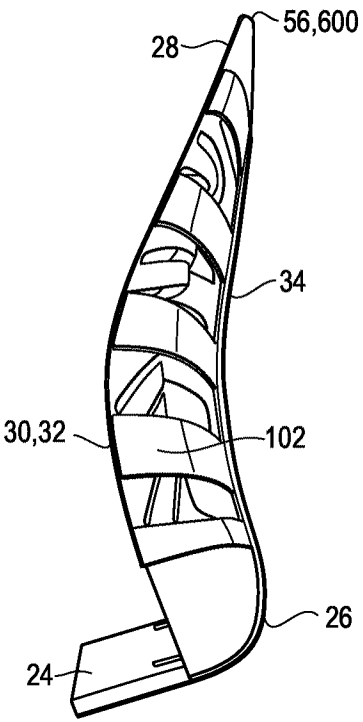
FIGS. 16A, B and C are front, rear and side views of another embodiment of a backrest.
Figure 16B:
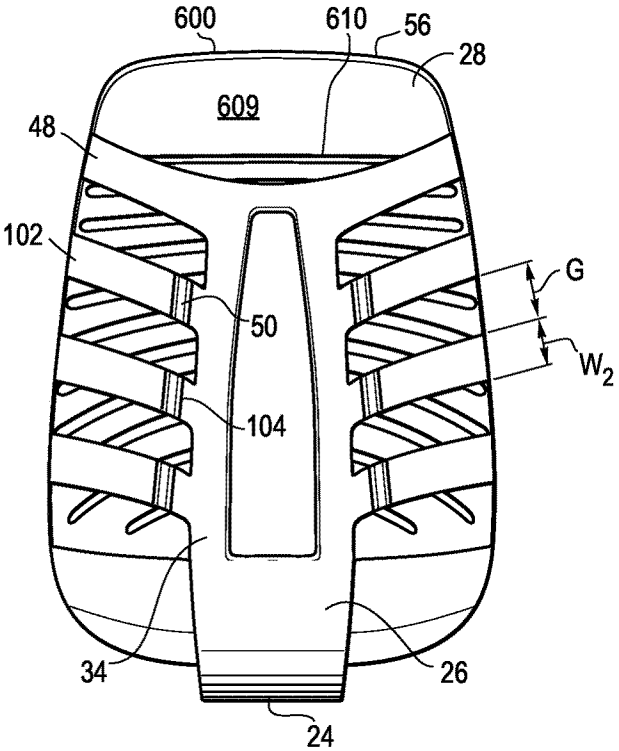
Figure 16A:
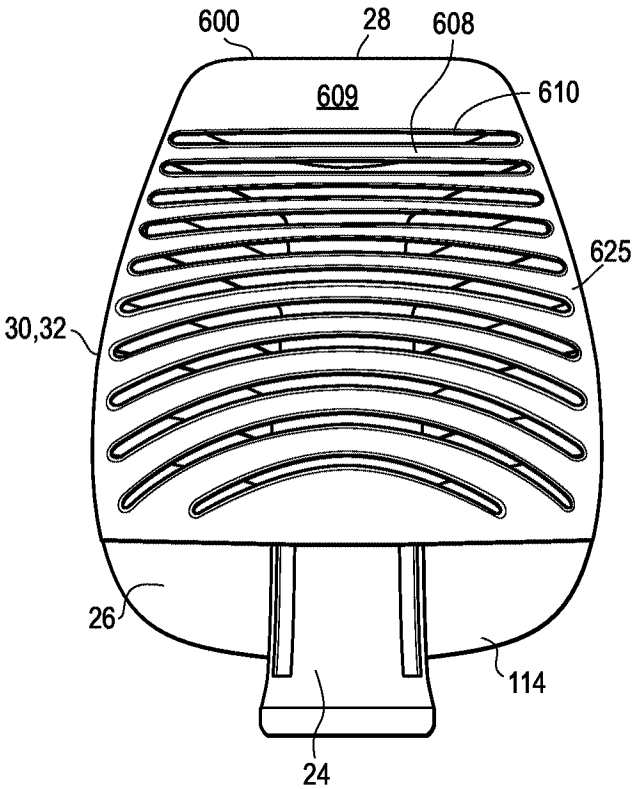

The bottom edge 110 of the backrest may have a convex curvature (FIGS. 14B, 16B), or a concave curvature FIG. 15B, with a cut-away positioned on each side of the central support member. As shown in FIG. 14B, a pair of openings 112 may be positioned on each side of the central portion 15 and/or support member 24. As shown in FIG. 16B, the shell includes a shroud portion 114, which extends laterally from each side of the central support member 24 and covers the rear of the seat 10.

Referring to FIG. 8, five longitudinally spaced linear, biasing arrays 100 are shown. The support members 120, 122, 124 of each linear biasing array are progressively bifurcated between the central portion and the outer peripheral edge. As shown, the support members are bifurcated every other support element. Each array has six columns of support members, transitioning as the array moves laterally outward from the central portion from two columns of one support element 120 to two columns of two support members 122 to two columns of four support members 124. In this embodiment, each array has fourteen (14) support members 120, 122, 124. Adjacent support members 120, 122, 124 within each array, and between arrays, are connected with pivot joints, including connectors 50, which are described above. It should be understood that the support members may be progressively divided by threes, fours or some other derivative other than bifurcation, and further that the splitting (e.g., bifurcation) may occur every column. Moreover, it should be understood that more or less than six columns may be incorporated into the array.

Figure 9B:
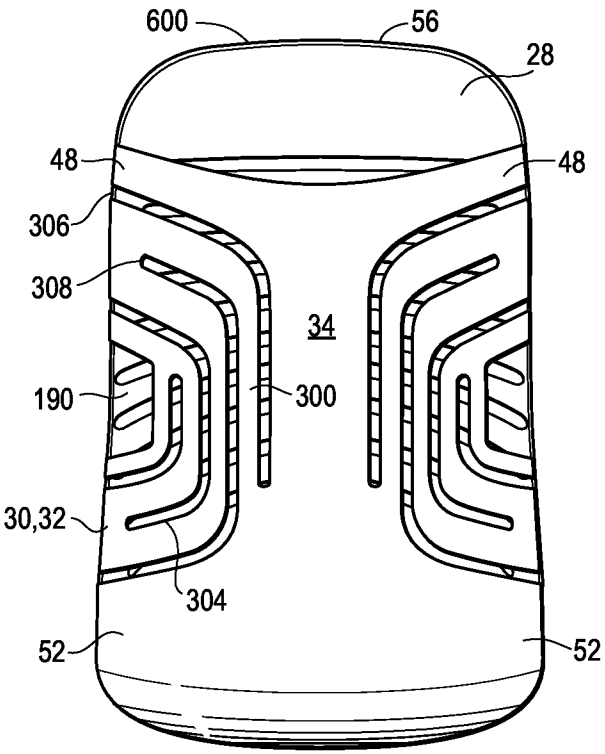
FIGS. 9A and B are rear views of other embodiments of a backrest.
Figure 9A:
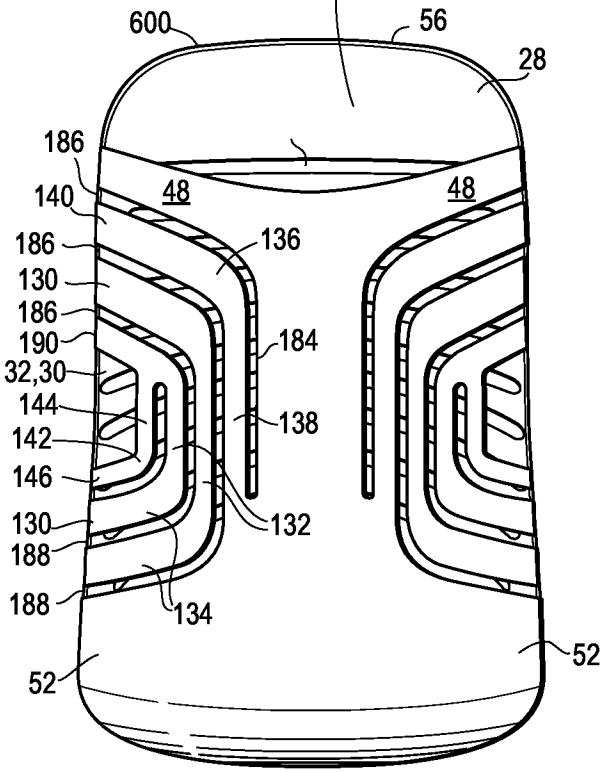
Figure 21C:
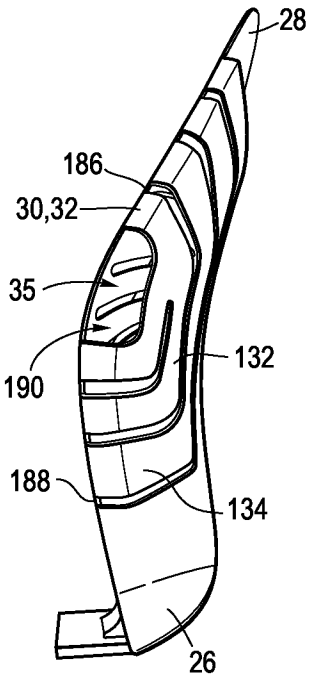
FIGS. 21A, B and C are font, rear and side views of another embodiment of a backrest.
Figure 21B:
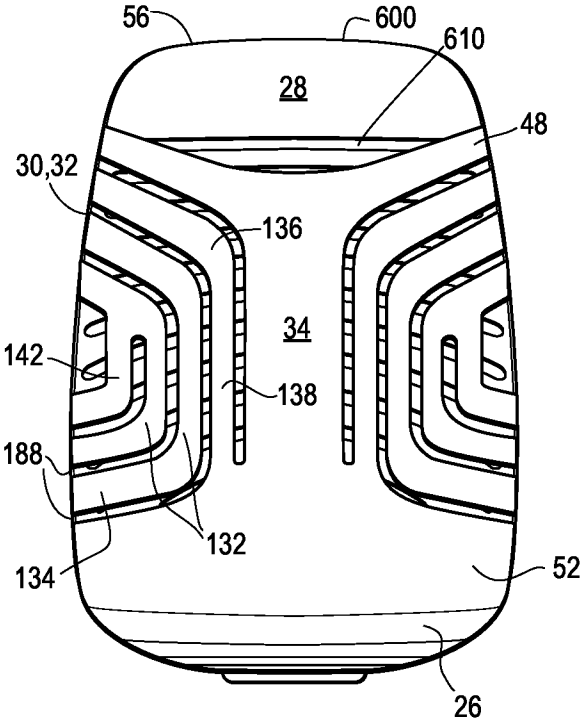
Figure 21A:
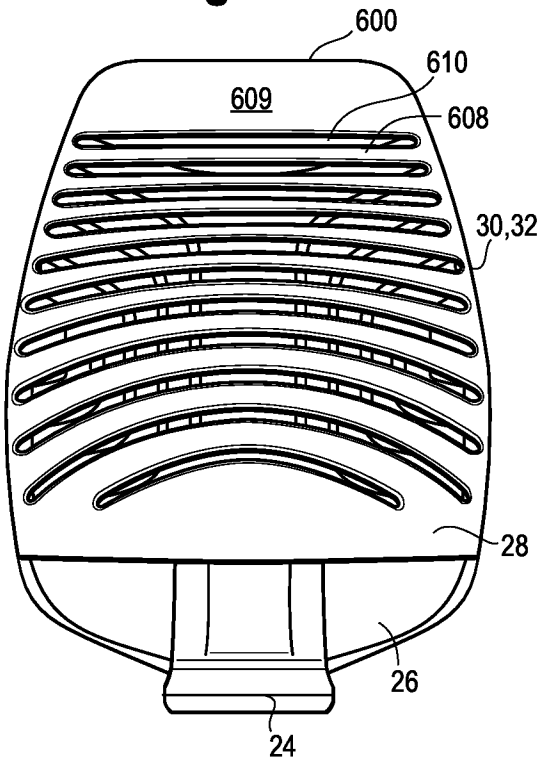
Figure 22C:
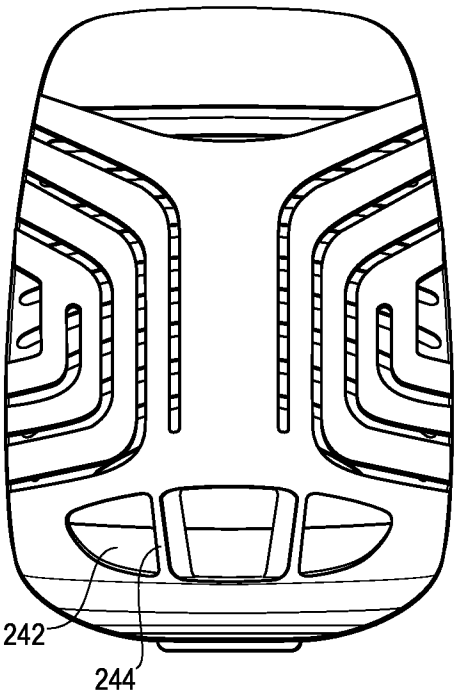
FIGS. 22A, B and C are rear views of various embodiments of load bearing shells.
Figure 22B:
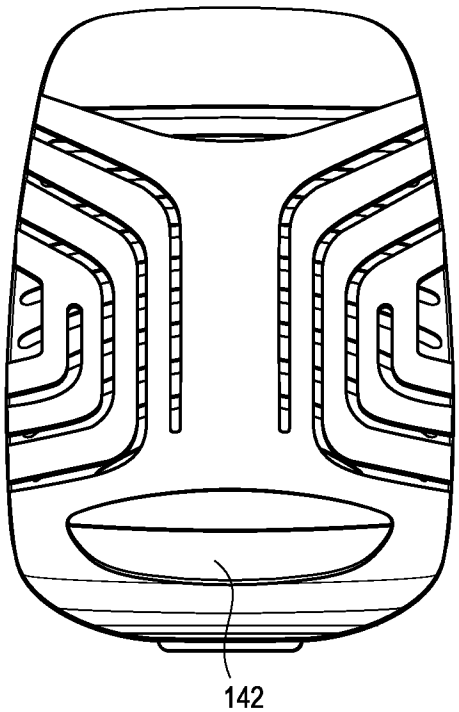
Figure 22A:
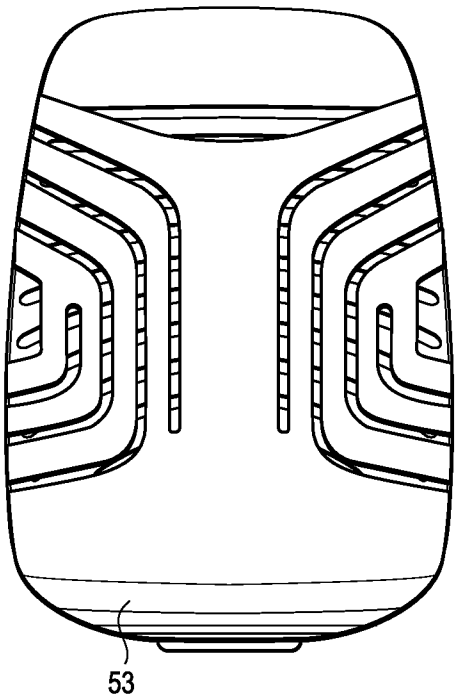
Figure 23:
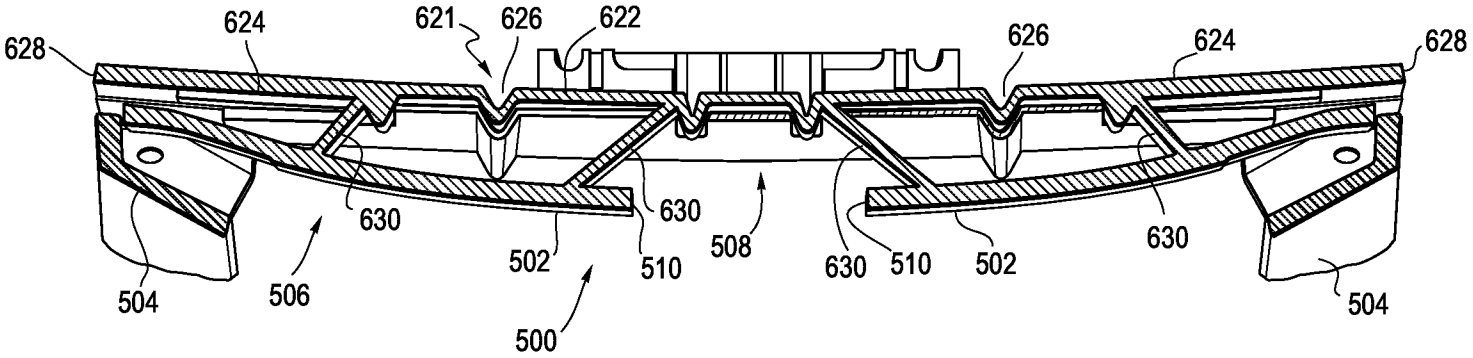
FIG. 23 is a cross-sectional view of another embodiment of a backrest.

Now referring to FIGS. 9A, 21B, C and 22A-C, at least a pair of nested support members 130 are U-shaped, with continuous longitudinal portions 132 and lateral portions 134. In addition, an innermost support element 136, having an inverted hockey stick shape, is configured with a longitudinal portion 138 coupled to and transitioning upwardly from the central portion and a lateral portion 140 extending to the outer peripheral edge 30. In this way, the longitudinal portion 138 may be integrally formed with the central portion, with no opening, pivot joint or connector located between the longitudinal 138 and central 34 portions. An outermost support member 142, having a hockey stick shape, is configured with a longitudinal portion 144 coupled to and transitioning downwardly from one of the U-shaped support members 130 and a lateral portion 146 extending to the outer peripheral edge 30. The support members are defined by a series of slots 184, all of which have at least one end 186 extending to the outer peripheral edge, and some of which have both ends 186, 188 extending to the outer peripheral edge. The support members may also be connected with various connectors 50. A pair of side openings 190 are framed by the outermost support members 130, 142, with the openings 190 communicating with the interior space between the load bearing and body supporting shells. As shown in FIG. 22A-C, the bottom portion 53 of the backrest may be filled in (FIG. 22A), have an opening 142 (FIG. 22B), or have an opening 242 with a plurality (shown as two) struts 244 extending in a longitudinal direction. As shown in FIG. 15B, the bottom edge, formed for example on arms 52, of the bottom portion 53 may be convex or concave.

Figure 20C:
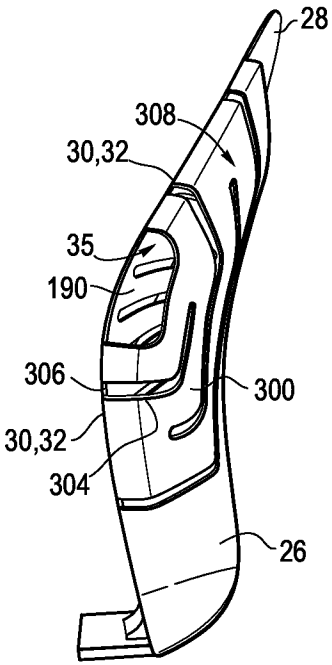
FIGS. 20A, B and C are font, rear and side views of another embodiment of a backrest.
Figure 20B:
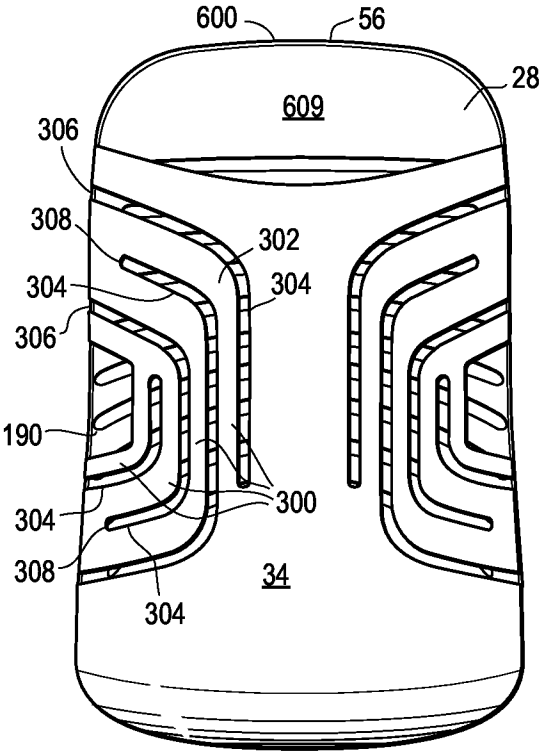
Figure 20A:
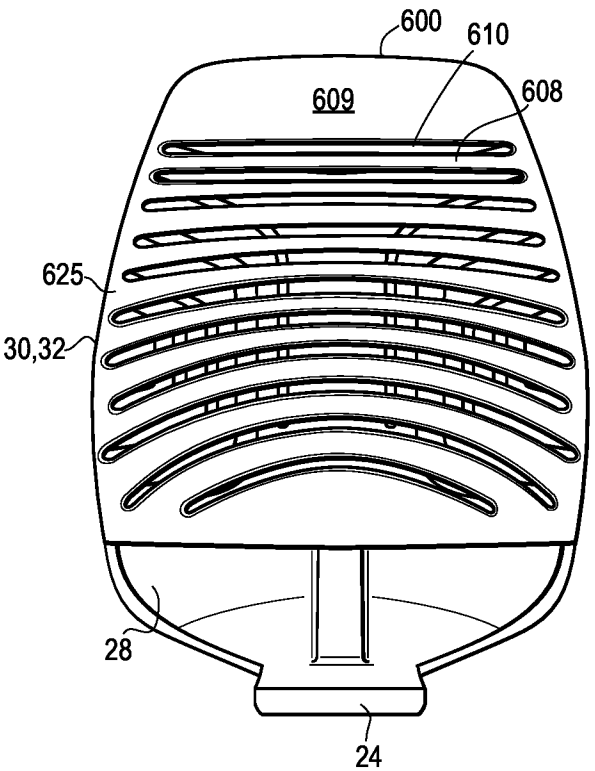

Referring to FIGS. 9B, 20B, C, a plurality of support members 300, having a general U-shape, are defined by a continuous serpentine element 302 extending between the central portion 34 and the outer peripheral edge 30. The element 302 does not have any openings or pivot joints separating the support members 300. The serpentine element is defined by a plurality of nested slots 304, each of which has one end 306 extending to the outer peripheral edge 30, and one end 308 spaced apart from the peripheral edge. The support members 300 may be connected with connectors 50. A pair of side openings 190 are framed by an outermost support element 300. It should be understood that while the support members in this embodiment are directly connected at end portions thereof with no openings or pivot joints defining the boundary there between, the support members are independently moveable relative to each other.

Figure 11C:
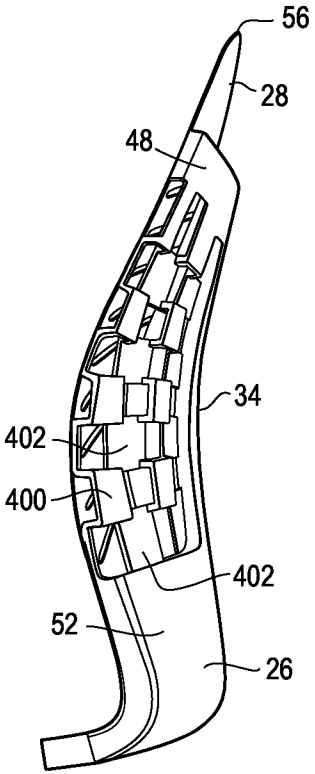
FIGS. 11A, B and C are front, rear, and side views of another embodiment of a backrest.
Figure 11B:
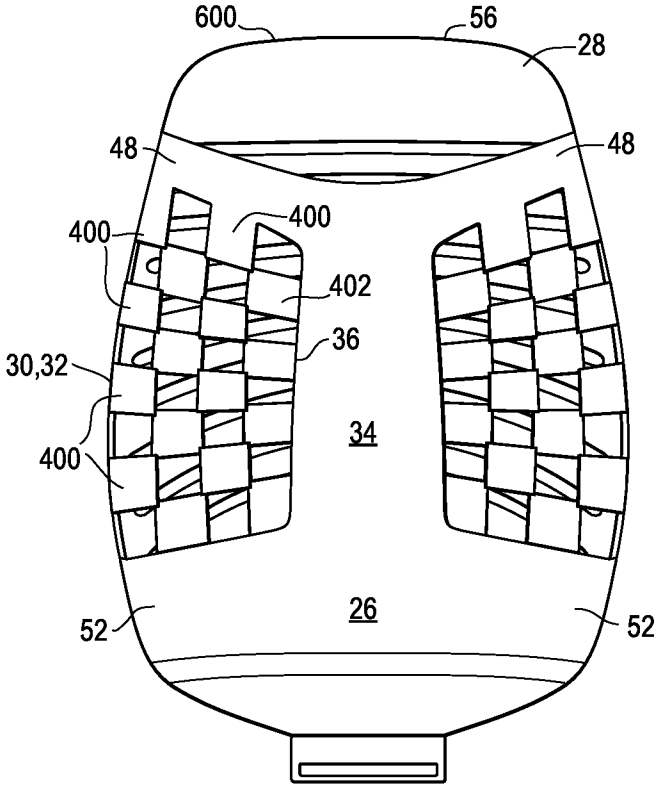
Figure 11A:
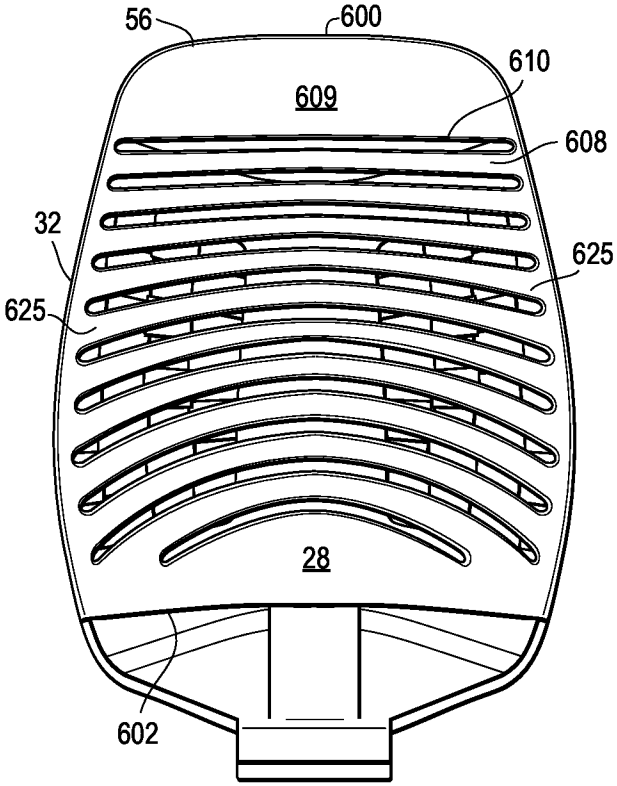
Figure 12C:
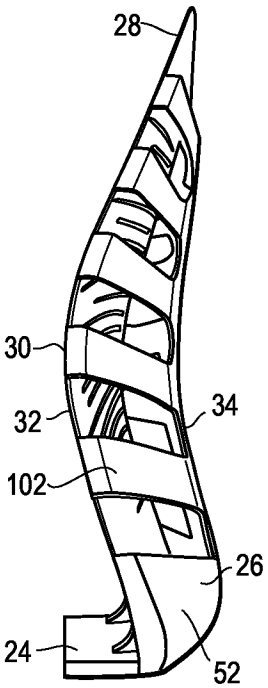
FIGS. 12A, B and C are front, rear and side views of another embodiment of a backrest.
Figure 12B:
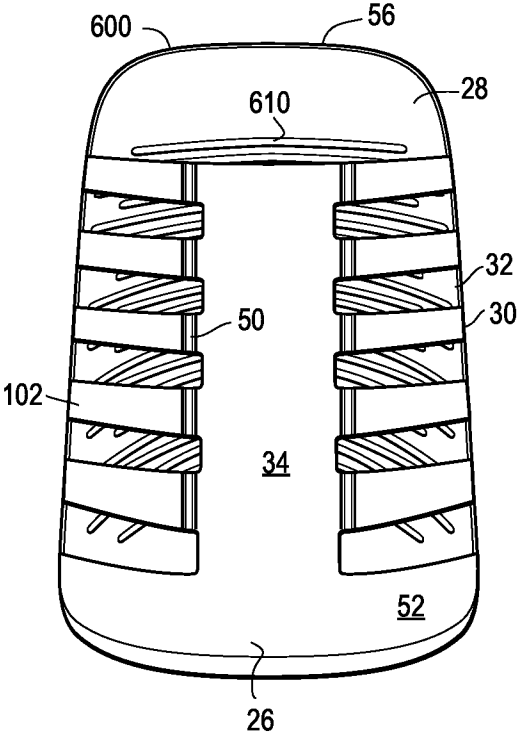

Referring to FIGS. 11A-C, a biasing array includes a plurality of support members 400, 402 arranged in a checkerboard pattern, with a first series of support members 402 offset in a fore/aft direction relative to a second series of support members 400, with adjacent support members 400, 402 in the first and second series being aligned and joined at their respective corners with connectors, or pivot joints, to form the checkerboard pattern. As shown, the array includes eight rows and four columns of support members, with two support members in each row and four support members in each column. Four support members 400 in the outermost column define the outer peripheral edge 30 of the load bearing shell 26.

Figure 19:
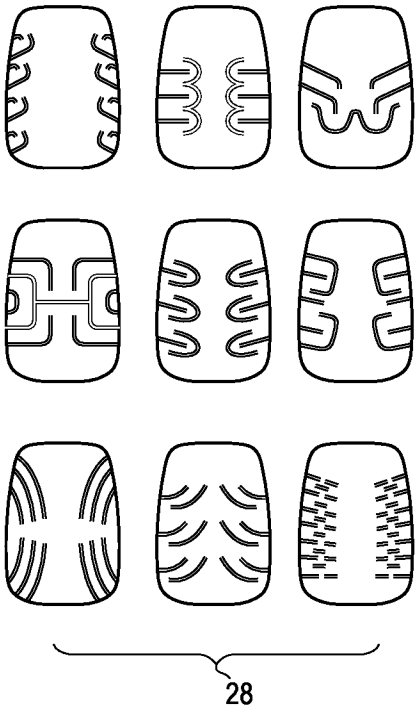
FIGS. 17, 18 and 19 are rear views of various load bearing shells.
Figure 18:
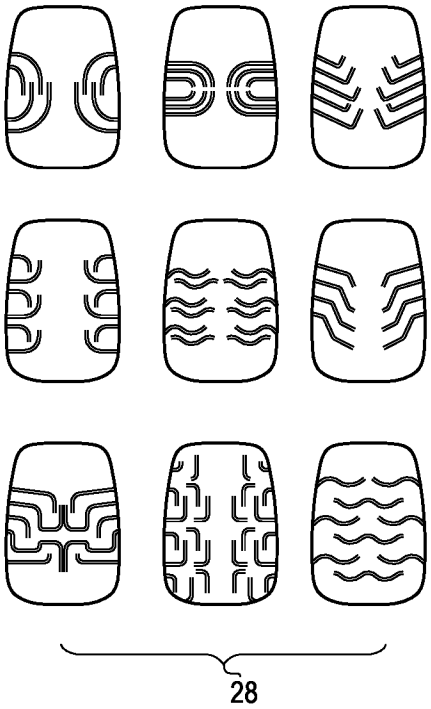
Figure 17:
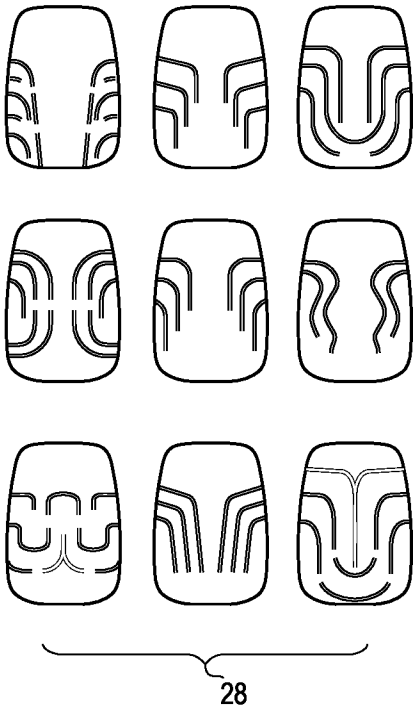

Referring to FIGS. 17, 18 and 19, various embodiments of a load bearing shell 26 are shown with various biasing arrays of support members defined by various slots, or other pivot joints and/or connectors. As shown, the shells have a central portion, with the biasing arrays extending from the central portion to the outer peripheral edges. At least some of the slots or other pivot joints extend to the outer peripheral edge in each embodiment. As shown, the slots or pivot joints may be linear, curved, curvilinear, bifurcated, or combinations thereof, and may extend in the longitudinal and/or lateral direction.

The various load bearing shells 26 provide a simple, inexpensive component for supporting the body of the user which does not require an additional frame, whether internal or external, although an external or internal frame may be secured to the central portion. The load bearing shell may be quickly and inexpensively molded. The central portion 34 provides overall support allowing some torsional movement about the central axis 64, while the biasing arrays allow the user to deflect, twist and manipulate the seating structure without encountering any hard points along the peripheral edges 30, which are deflectable in a fore/aft direction to provide a soft edge.

Referring to FIGS. 23-27, another embodiment of a seating structure is shown. In this embodiment, a plurality of load-bearing members, or rear support members 500, have outer ends fixed, or non-movably coupled to a support frame having a pair of laterally spaced frame members 504 or uprights defining an open space 506 there between. The support frame may be coupled to a base, such as a chair control housing. The load-bearing members may be formed as individual beams, or may be arranged in an integrated array, for example as a shell.

Each rear support member 500 has a pair of load bearing segments 502 with inner ends 510 thereof being laterally spaced apart to define a gap 508 there between. In an alternative embodiment, the segments 502 may be joined with a spring 502 to pre-load the support member, as shown in FIG. 26A.

Body-Supporting Components:

Referring to FIGS. 1-4, 8-16C, 20A-22C and 31, the body-supporting shell 28 has top 600, bottom 602 and outer peripheral edges 32. The body-supporting shell 28 is made of a relatively thin plastic material, for example polypropylene. The shell has an outer surface 604 (forwardly or upwardly facing) that supports the body of a user. The outer surface may be the outermost surface, or it may be covered with a cushion, mat, fabric or other covering 606, as shown for example in FIG. 13A. The outer peripheral edges 32 are joined with the outer peripheral edges 30 of the load bearing shell, which may be the only connection between the shells 26, 28, with interior surfaces of each shell 26, 28 being spaced apart to define the open space 35 or cavity there between. The outer peripheral edges 30, 32 may be directly connected, with no space or linking members extending there between, or may be connected with various connectors 50, 150, 250, which define the edge 30 of the load bearing shell. The edge 30, 32 may be co-molded, or coupled with a snap fit, adhesive, bonding, mechanical fasteners (see FIGS. 28 and 29), or combinations thereof. The connectors 50, 150, 250 may extend into the open space, but are not engaged or in contact with the interior surface of the body-supporting shell 28. In this way, the connectors 50, 150, 250 are disposed between the shells 26, 28 and are hidden from view. The top and bottom edges 600, 602 may be connected to the load bearing shell (tops connected as shown FIGS. 32 and 33), or may remain free from any connection as shown in FIGS. 3 and 4 for example.

Figure 31:
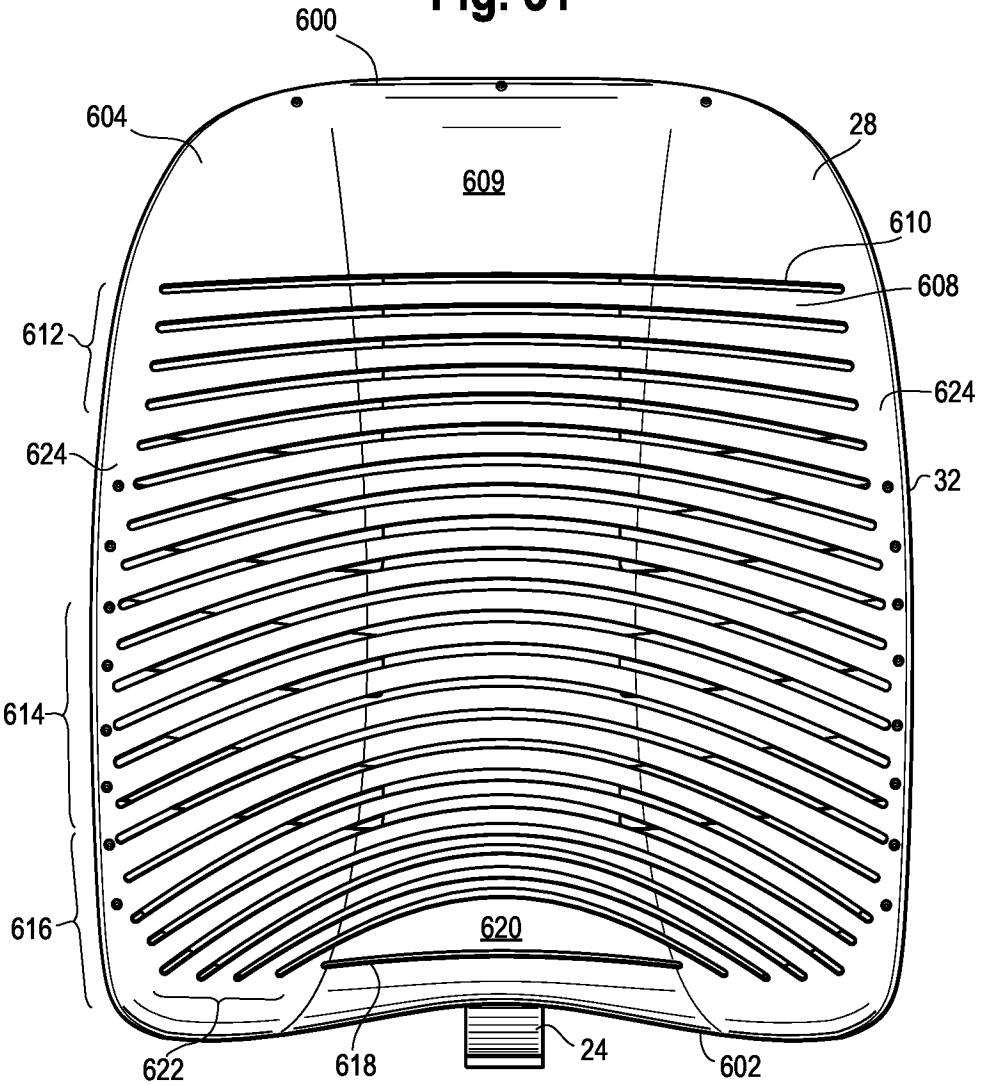
FIG. 31 is a front view of one embodiment of a backrest.

In one embodiment, the body supporting shell 28 has a plurality of longitudinally spaced and laterally extending strips 608 defined by longitudinally spaced and laterally extending slots 610. An upper portion 609 of the backrest may be free of any slots. The slots may be formed as through openings or channels, or the slots may be replaced by other lines of weakness, for example scoring, or thinner or different material(s), perforations or combinations thereof, between the strips 608. At least some of the slots are arcuate shaped. For example, as shown in FIGS. 1, 2 and 31, the slots 610, and strips 608, are substantially linear at the top, or thoracic region, of the backrest. The slots, and strips, may have different curvatures relative to other slots and strips. For example, the slots and strips may be progressively configured with more curvature moving from the top to the bottom of the backrest, with the slots and strips having a greater amount of curvature or arc (downwardly directed) in the lumbar/sacral regions 614, 616 of the backrest. The curved strips 608 may twist or rotate about the ends thereof, or the connection of the strips 608 to the edge portion 625, with the curvature providing more movement than linear strips. In one embodiment, shown in FIGS. 1 and 31, a bottommost straight, or linear, slot 618 is provided, forming a segment shaped sacral support 620 at the bottom of the backrest. The support 620 may rotate about a horizontal axis, defined for example by the material joining the support 620 to the bottom of the shell at the ends of the slot 618. A plurality of slots 622 arranged along the bottom of the backrest terminate along a generally horizontal line that is co-linear with, or parallel to, the bottommost slot 618. While the slots preferably have a linear or downwardly concave shape, it should be understood that some of the slots may be oriented in an opposite direction.

Figure 12A:
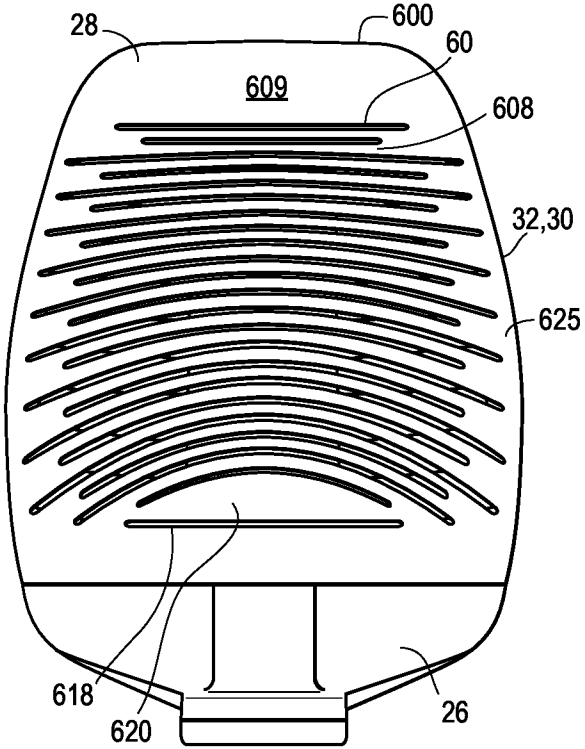
Figure 13C:
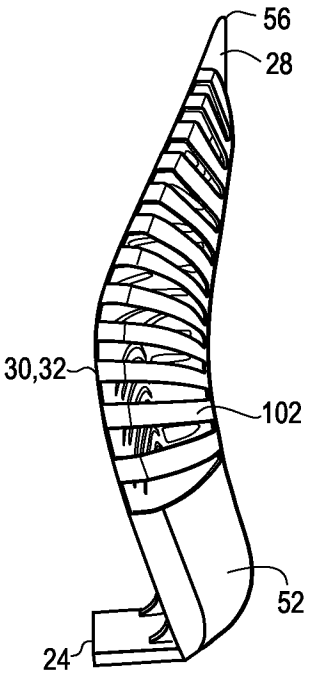
FIGS. 13A, B and C are front, rear and side views of another embodiment of a backrest.
Figure 13B:
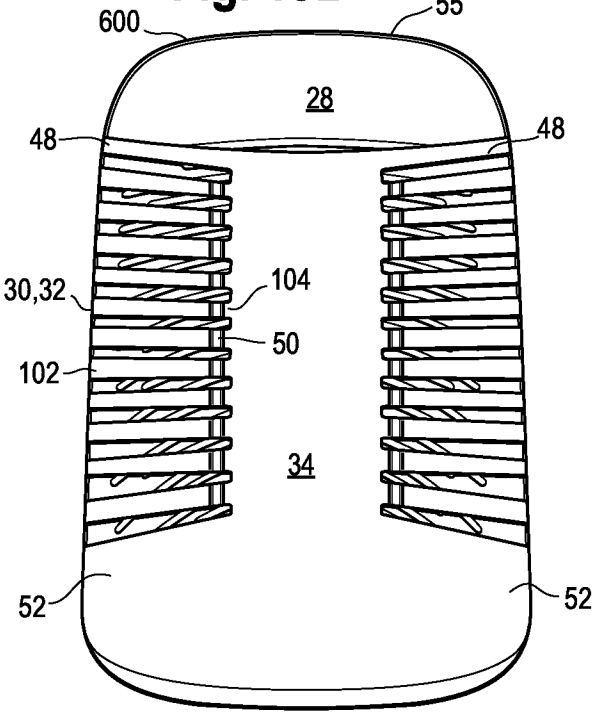
Figure 13A:
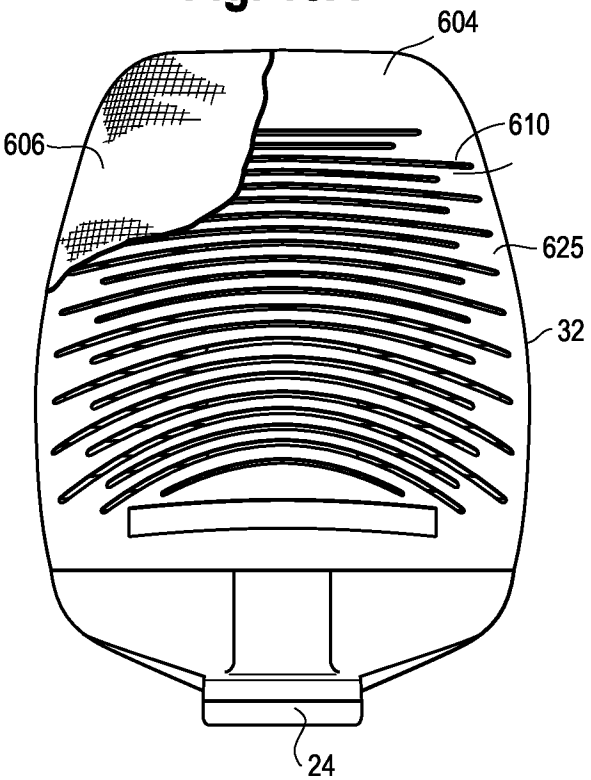
Figure 14A:
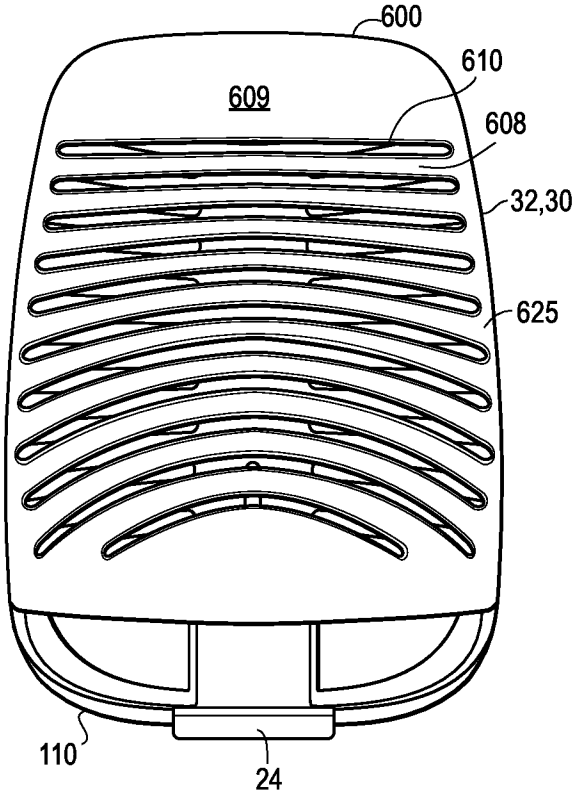
Figure 15A:
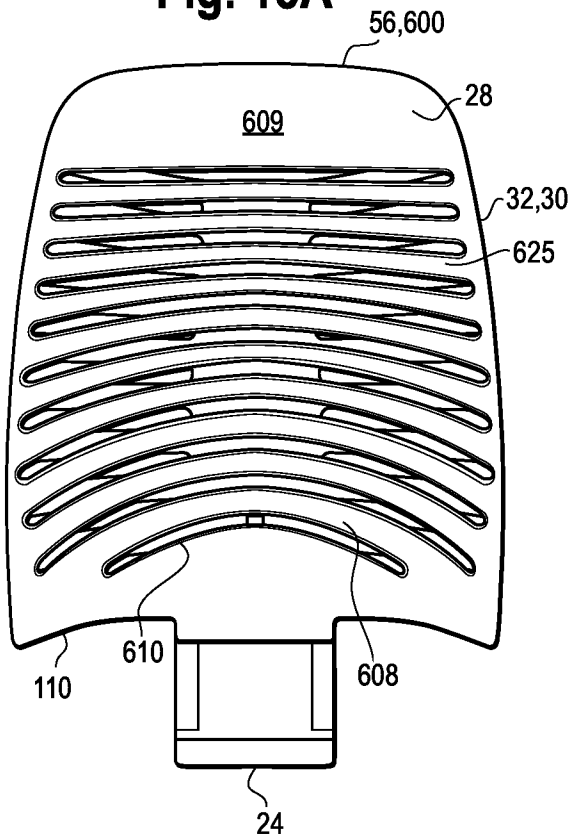
Figure 31A:
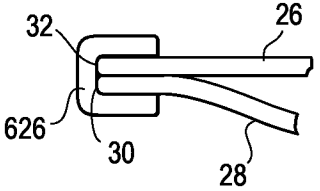
FIG. 31A is an enlarged partial cross section showing an edge trim applied to the load bearing and body supporting shells.

As shown, the slots 610, 618, 622 preferably do not extend to the outer peripheral edge 32, such that a longitudinal edge portion 625 runs along each side of the shell and defines the edge 32, with the edge portion 625 being secured to the outer peripheral edge 30 of the load bearing shell. The slots 610 may be extend to the same boundary, e.g., an offset from the edge 32 as shown in FIGS. 11A, 14A and 15A, or may be staggered, alternating between long or short slots as shown in FIGS. 12A and 13A. The first and second shells 28, 26 may be integrally formed, for example by a single molding process, or may be overmolded, one on the other. In addition, an edge trim 626, shown in FIG. 31A, may be coupled to and cover the outer peripheral edges of the first and second shells. For example, the edge trim 626 may be over molded on the edges 30, 32. The edge trim 626 may be made of an elastomeric material, which provides a softer edge.

As shown in FIG. 1, slots 610 and strips 608 in the seat may also be progressively curved towards the rear of the seat, although an opposite configuration is possible. Again, the slots and strips may be linear, curved, curvilinear or combinations thereof.

It should be understood that the body supporting shell may be made without any slots or openings, or be made with differently shaped and positioned openings, such as circular openings.

Figure 24:
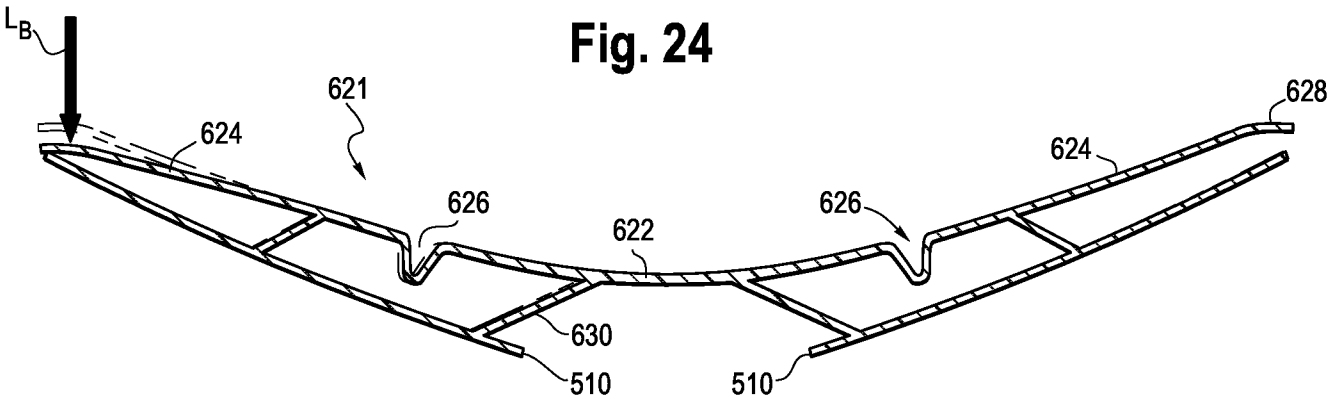
FIG. 24 is a cross-sectional view of the backrest shown in FIG. 23 with a central load and a side load being applied simultaneously to a body supporting member.

Referring to the embodiment of FIGS. 23-27, a front body supporting member 621 has three support segments 622, 624, with two outboard segments 624 pivotally joined to an intermediate segment 622, for example with a living hinge or pivot joint 626. Outer ends of the outboard segments are free ends 628, meaning the outer ends are not fixed to any structure and may deflect rearwardly toward the rear support member 500 as shown in FIG. 24. In this way, the seating structure is provided with a soft-edge along an outer periphery thereof, notwithstanding the underlying frame uprights, such that the edge may be deflected independently of the overall deflection of the seating structure. Each rear support member segment 502 is connected to the front body-supporting member with a pair of links 630, one link 630 joining the rear support member segment 502 to the outer segment 624, and one link 630 joining the rear support member segment to the intermediate segment 622. Preferably, the links 630 are angle inwardly form the rear support member toward the front member.

Figure 25:
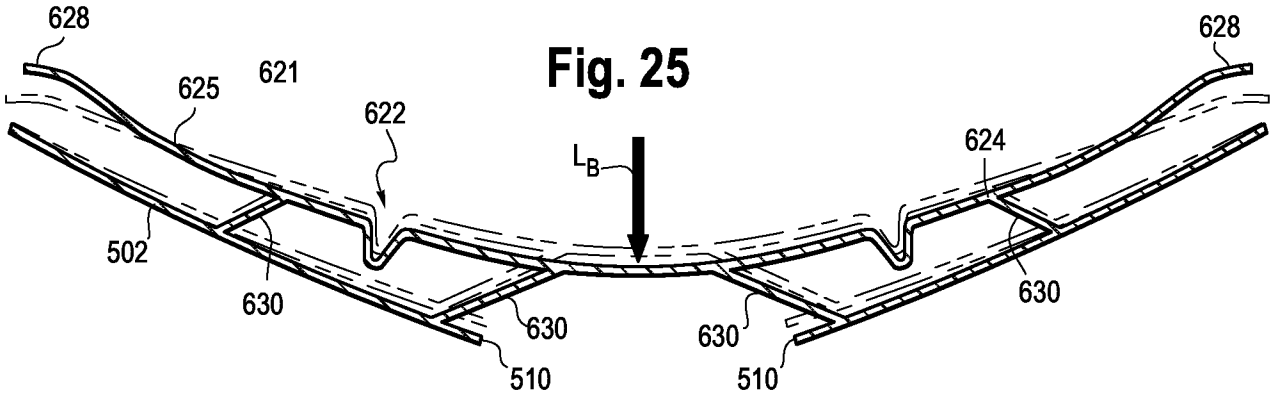
FIG. 25 is a cross-sectional view of the backrest shown in FIG. 23 with a central load being applied to a body supporting member.

The body supporting member may also flex rearwardly and curve inwardly as shown in FIG. 25, with the free edges 628 moving forwardly to hug the user. As the beam flexes, the linking members 630 flatten out and are put in tension.

Figure 27:
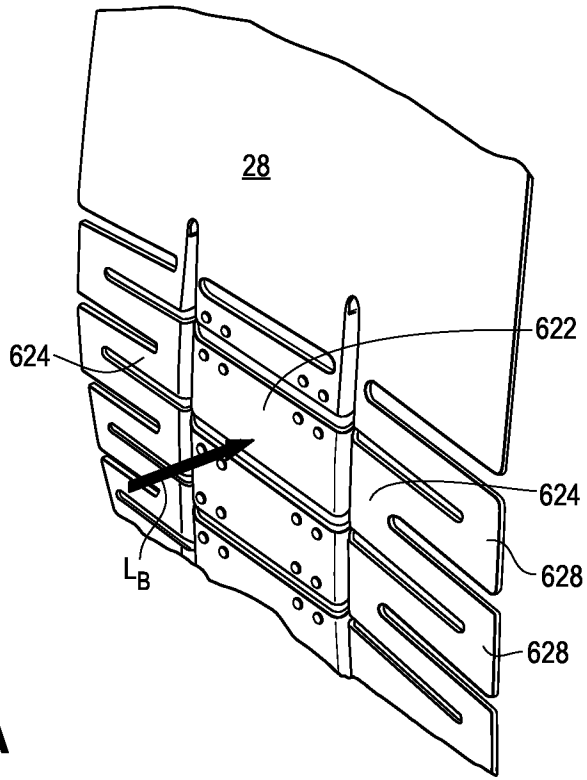
FIG. 27 is a front perspective view of the backrest shown in FIG. 26.
Figure 26:
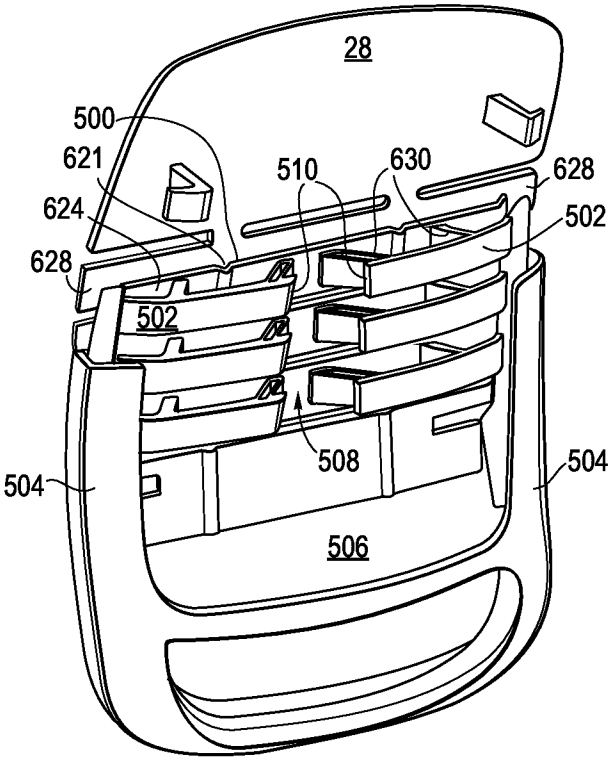
FIG. 26 is a rear perspective view of the backrest shown in FIG. 23.
Figure 26A:
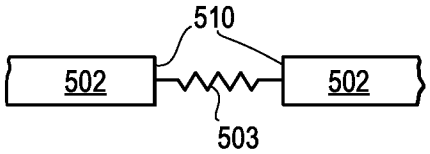
FIG. 26A is a partial view of a load bearing member.

As shown in FIGS. 26 and 27, the body supporting members may be integrally formed as a shell, with the free ends 628 of each individual member being split, meaning ½ of the free end defines in part a first beam, and the other ½ of the free end defines in part a next lower (or upper) beam, with the two free ends joined and forming a serpentine connector between the beams so as to form an integral shell.

Referring to FIGS. 28-30, body supporting members may be formed as individual members forming a part of a beam, or may be positioned side by side to form an integral body supporting shell 28.

Figure 32:
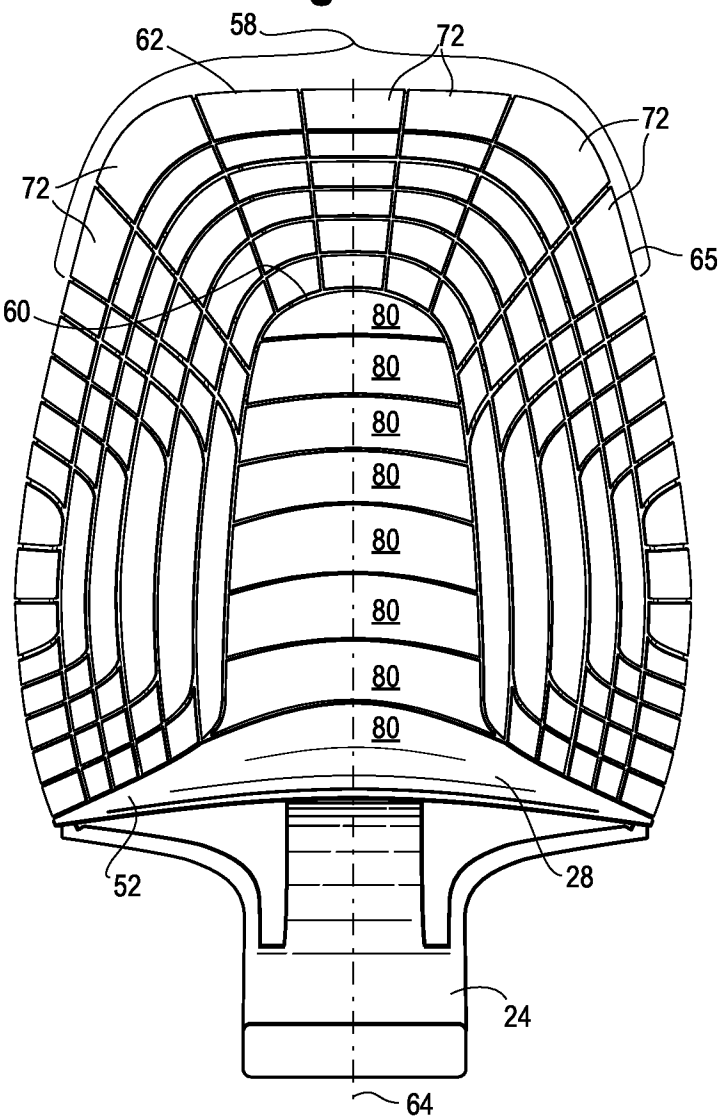
FIG. 32 is a front view of one embodiment of a backrest.

Referring to FIG. 32, the body supporting member may also be configured with an array of support elements similar to the array of the load bearing shell. A central portion of the shell may be divided into a plurality of segments 80, with adjacent segments joined for example by pivot joints, including connectors and slots and a bottommost segment 128 defining a pair of arms. A central array 172 is centered along the longitudinal axis 64. The arrays 72 may be configured as a linear array of support members, with the width of the support members progressively increasing from the central portion to the upper peripheral edge 62, with the array 172 thus being generally wedge shaped, although not terminating at a point along the end portion 60. The adjacent support members 76 within each array are bounded or separated by a pivot joint, configured in one embodiment as an opening such as a slot 78 or channel and connectors 50.

It should be understood that various seating structures may be configured with only a load bearing shell or only a body supporting shell, for example with the load bearing shell also serving as a body supporting member.

Operation:

In operation, the user $L_B$ applies a force to the body-supporting member or shell 28. The various strips 608 provide flexibility and support the user, with the strips 608 rotating or twisting. The user may twist side to side, applying a torque to the body supporting member about a central, longitudinal axis 64, 66. The strips 608 may deflect inwardly into the open space 35 without bottoming out or experiencing any hard stops, thereby providing the user with increased comfort. In addition, the edges 625 may be deflected (rearwardly or forwardly depending on where the load is applied), thereby providing a soft edge. At the same time, the biasing arrays of the load bearing shell 26 absorb the load applied by the body supporting shell and deflect to provide maximum comfort.

The user $L_B$ load is transferred from the body supporting shell 28 or member to the load bearing shell 26 or member between and along the outer peripheral edges 30, 32. The biasing arrays of the load bearing shell 26 then transfer the load to the central portion 34, directly, and/or through the support arms 48, 52. The transfer of load includes elastically deforming at least some of the connectors 50, 150, 250 and/or support members, and/or combinations thereof, whether through expansion, contraction, bending and/or twisting.

As shown in FIG. 28, the body supporting member may flex rearwardly with the outer peripheral edges 30, 32 moving forwardly to hug the user. Alternatively, as shown in FIG. 29, the peripheral outer edge 30, 32 provides a soft edge to a load applied thereto, allowing for independent deflection of the edge. Referring to FIG. 30, loads applied across the body support member or shell 28, including both outer edges 32, leads to an overall deflection or flattening, of the body support member/shell 28 and load bearing member/shell 26.

The various seating structure embodiments disclosed herein provide a soft outer peripheral edge 30, 32, which allows the user $L_B$ to bear against and flex the peripheral edge without encountering a hard contact point, or allows for the edge to move forwardly and hug the user in certain use configurations. The peripheral edges are independently flexible and responsive to loads being applied to the backrest. In addition, the central portion 34 of various embodiments provides an anchor or support structure about which the various biasing arrays may be arranged. The central support and biasing arrays may be tuned to optimize and vary support in various desired locations, for example and without limitation the lumbar, thoracic and pelvic regions of a backrest, or the thigh and buttock regions of a seat. In various embodiments, the dual shell structure allows for independent tuning of both the load bearing shell and the body supporting shell.

It should be understood that while many of the embodiments have been described herein with respect to a backrest construction, the same embodiments are equally applicable to a seat construction, or to other body support structures such as a bed, sofa or vehicular seating structure.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support structure comprising:

a plurality of spaced apart support members defining a first surface, wherein adjacent support members define openings between sides of the adjacent support members, wherein an entire periphery of each of the support members is surrounded by the openings;

a plurality of spaced apart base portions defining a second surface, wherein the second surface is spaced apart from the first surface and wherein the plurality of support members and the plurality of base portions define a space therebetween, wherein each of the base portions underlies at least portions of the openings defined by at least four adjacent support members and are connected to the four adjacent support members, wherein adjacent base portions define openings between sides of the adjacent base portions, wherein an entire periphery of each of the base portions is surrounded by the openings defined between adjacent base portions, wherein the support members are only connected to the base portions underlying the openings defined between the support members, and wherein the base portions are not otherwise supported by any other structure; and a plurality of connectors extending across the space and connecting each base portion with the at least four adjacent support members.

2. The body support structure of claim 1 wherein the at least portions of the openings defined by the at least four adjacent support members have a cross shape.

3. The body support structure of claim 1 wherein at least some of the plurality of support members are rectangular.

4. The body support structure of claim 3 wherein at least some of the plurality of base portions are rectangular.

5. The body support structure of claim 1 wherein the plurality of support members have outer surfaces defining the first surface.

6. The body support structure of claim 5 wherein the plurality of base portions have outer surfaces defining the second surface.

7. The body support structure of claim 6 wherein the outer surfaces of the support members and base portions faces away from each other.

8. The body support structure of claim 7 wherein the plurality of support members have inner surfaces and the plurality of base portions have inner surfaces, wherein the inner surfaces of the support members face towards the inner surfaces of the base portions.

9. The body support structure of claim 8 wherein the plurality of connectors extend between the inner surfaces of the support members and the inner surfaces of the base portions.

10. A body support structure comprising:

a plurality of spaced apart support members defining a first surface, wherein adjacent support members define openings between sides of the adjacent support members;

a plurality of spaced apart base portions defining a second surface, wherein the second surface is spaced apart from the first surface and wherein the plurality of support members and the plurality of base portions define a space therebetween, wherein each of the base portions underlies at least portions of the openings defined by at least four adjacent support members, and wherein adjacent base portions define openings between sides of the adjacent base portions; and a plurality of connectors extending across the space and connecting each base portion with the at least four adjacent support members, wherein at least some of the connectors comprise parallel linear legs.

11. The body support structure of claim 1 wherein at least portions of the first and second surfaces are planar.

12. The body support structure of claim 1 wherein the first and second surfaces are curved.

13. The body support structure of claim 1 wherein portions of the openings between adjacent support members are aligned with portions of the openings between adjacent base portions so as to define a plurality of through openings extending between the first and second surfaces.

14. A seat comprising the body support structure of claim 1.

15. A backrest comprising the body support structure of claim 1.

16. A body support structure comprising:

a first plurality of spaced apart rectangular first support members defining a first surface, wherein each of the first support members has four corners, and wherein adjacent first support members define openings between corners and sides of the adjacent first support members, wherein an entire periphery of each of the first support members is surrounded by the openings;

a second plurality of spaced apart rectangular second support members offset from the first plurality of support members, wherein each of the second support members has four corners, wherein adjacent second support members define openings between the corners and sides of the adjacent second support members, wherein an entire periphery of each of the second support members is surrounded by the openings defined between the adjacent second support members, wherein at least some of the second support members underlie at least portions of the openings defined by at least four adjacent first support members, wherein the second support members are not otherwise supported by any other structure, and wherein the first and second pluralities of first and second support member are arranged in a checkerboard pattern, wherein the corners of each of the first support members are aligned with and overlie the corners of four adjacent second support members; and a plurality of connectors extending between the aligned corners of the first and second pluralities of first and second support members.

17. The body support structure of claim 16 wherein the plurality of first support members have outer surfaces defining the first surface.

18. The body support structure of claim 17 wherein the plurality of second support members have outer surfaces defining the second surface.

19. The body support structure of claim 18 wherein the outer surfaces of the first and second support members face away from each other.

20. The body support structure of claim 19 wherein the plurality of first support members have inner surfaces and the plurality of second support members have inner surfaces, wherein the inner surfaces of the first support members face towards the inner surfaces of the second support members.

21. The body support structure of claim 20 wherein the plurality of connectors extend between the inner surfaces of the first and second support members.

22. A body support structure comprising:

a first plurality of spaced apart rectangular first support members defining a first surface, wherein each of the first support members has four corners, and wherein adjacent first support members define openings between corners of the adjacent first support members;

a second plurality of spaced apart rectangular second support members offset from the first plurality of support members, wherein each of the second support members has four corners, and wherein the first and second pluralities of first and second support member are arranged in a checkboard pattern, wherein the corners of each of the first support members are aligned with and overlie the corners of four adjacent second support members; and a plurality of connectors extending between the aligned corners of the first and second pluralities of first and second support members, wherein the plurality of connectors extend between the inner surfaces of the first and second support members, and wherein at least some of the connectors comprise parallel linear legs.

23. The body support structure of claim 16 wherein at least portions of the first and second surfaces are planar.

24. The body support structure of claim 16 wherein the first and second surfaces are curved.

25. The body support structure of claim 16 wherein portions of the openings between adjacent first support members are aligned with portions of the openings between adjacent second support members so as to define a plurality of through openings extending between the first and second surfaces.

* * * * *